US007187752B2

(12) United States Patent
Kotler et al.

(10) Patent No.: US 7,187,752 B2
(45) **Date of Patent: *Mar. 6, 2007**

(54) PRODUCT IRRADIATOR FOR OPTIMIZING DOSE UNIFORMITY IN PRODUCTS

(75) Inventors: Jiri Kotler, Nepean (CA); Joseph Borsa, Stittsville (CA)

(73) Assignee: MDS (Cananda) Inc., Kanata (CA)

( * ) Notice: Subject to any disclaimer, the term of this patent is extended or adjusted under 35 U.S.C. 154(b) by 76 days.

This patent is subject to a terminal disclaimer.

(21) Appl. No.: 10/272,889

(22) Filed: Oct. 17, 2002

(65) Prior Publication Data

US 2003/0128807 A1 Jul. 10, 2003

Related U.S. Application Data

(63) Continuation of application No. PCT/CA01/00496, filed on Apr. 17, 2001, which is a continuation-in-part of application No. 09/550,923, filed on Apr. 17, 2000, now Pat. No. 6,504,898.

(51) Int. Cl.
*G21K 5/00* (2006.01)

(52) U.S. Cl. ..... 378/69; 378/64; 378/68; 250/453.11

(58) Field of Classification Search ..... 378/64, 378/68, 69, 95, 147, 150, 151, 208; 250/453.11, 250/454.11
See application file for complete search history.

(56) References Cited

U.S. PATENT DOCUMENTS 2,559,526 A * 7/1951 Van De Graaff et al. ... 378/141
3,992,633 A * 11/1976 Braun et al. ..... 378/2
4,157,475 A * 6/1979 Stock et al. ..... 378/147
4,361,901 A * 11/1982 Daniels et al. ..... 378/106
4,884,292 A * 11/1989 Klostermann ..... 378/127
5,023,895 A * 6/1991 McCroskey et al. ..... 378/4
5,278,886 A * 1/1994 Kobiki et al. ..... 378/65
5,332,908 A * 7/1994 Weidlich ..... 250/492.1
5,351,280 A * 9/1994 Swerdloff et al. ..... 378/65
5,668,371 A * 9/1997 Deasy et al. ..... 250/306
6,219,403 B1 * 4/2001 Nishihara ..... 378/65
6,260,005 B1 * 7/2001 Yang et al. ..... 703/11
6,266,393 B1 * 7/2001 Ein-Gal ..... 378/147
6,504,898 B1 * 1/2003 Kotler et al. ..... 378/64

FOREIGN PATENT DOCUMENTS

JP 07265445 A * 10/1995
JP 09215760 A * 8/1997
WO WO 9940523 A1 * 8/1999

* cited by examiner

*Primary Examiner*—Edward Glick
*Assistant Examiner*—Chih-Cheng Glen Kao
(74) *Attorney, Agent, or Firm*—Haynes and Boone, LLP

(57) ABSTRACT

An apparatus and method for irradiating a product or product stack with a relatively even radiation dose distribution is provided. The apparatus comprises a radiation source, an adjustable collimator, a turn-table capable of receiving a product stack and a control system capable of adjusting the adjustable collimator to vary the geometry of the radiation beam as the product stack is rotated in the radiation beam. Also disclosed is the modulation of the radiation beam energy and power and varying the angular rotational velocity of the product stack in a radiation beam to achieve a low dose uniformity ratio in the product stack.

91 Claims, 26 Drawing Sheets

PROCESS CONTROL ALGORITHM

PRODUCT IRRADIATOR FOR OPTIMIZING DOSE UNIFORMITY IN PRODUCTS

This application is a continuation of International Application No. PCT/CA01/00496, filed on Apr. 17, 2001, which is a continuation-in-part of U.S. application Ser. No. 09/550,923, filed on Apr. 17, 2000, now U.S. Pat. No. 6,504,898.

The present invention relates to a method and apparatus for irradiating products to achieve a radiation dose distribution that satisfies specified dose uniformity criteria throughout the product.

BACKGROUND OF THE INVENTION

The treatment of products using radiation is well established as an effective method of treating materials such as medical devices or food stuffs. Radiation processing of products typically involves loading products into totes and introducing a plurality of totes either on a continuous conveyer, or in bulk, into a radiation chamber. Within the chamber the product stacks pass by a radiation source until the desired radiation dosage is received by the product and the totes are removed from the chamber. As a plurality of products, typically within totes, are present in the chamber at a given time, the radiation processing parameters affect all of the product within the chamber at the same time.

One common problem in the radiation processing of products is that the effectiveness of radiation processing is sensitive to variations in product density and geometry, and product source geometry. If a radiation chamber is loaded with totes comprising products with a range of densities and geometries,certain products will tend to be over-exposed to the radiation, while others do not achieved the required dose, especially within the central regions of the product. To overcome this problem the radiation chamber is typically loaded with products according to a specified and validated configuration so that the processing of the products satisfies a specified dose uniformity criteria. However, this is not always possible as some product package configurations are not compatible with achieving a good dose uniformity when irradiation is carried out in the conventional manner.

Products of a large dimension, and high density suffer from a high dose uniformity ratio (DUR) across the product. A relatively even radiation dose distribution (small DUR) is desirable for all products, but especially so for the treatment of foods, such as red meats and poultry. In treatment of these products, an application of an effective radiation dose to reduce pathogens at the centre of the stack is often limited by associated undesirable sensory or other changes in the periphery of the product stack as a result of the higher radiation dose delivered to material in this region of the product. A similar situation may arise during the radiation sterilization of medical disposable products, a majority of which may be made from plastic materials. In these cases, the maximum permissible radiation dose in a product may be limited by undesirable changes in the characteristics of the plastics, such as increased embrittlement of polypropylene or decoloration and smell development of polyvinyl chloride. In order to adequately and thoroughly treat product stacks of such products with radiation processing, a relatively even radiation dose distribution characterized by a low DUR must be delivered throughout the product stack.

Radiation processing of materials and products has most often been accomplished using electron beams, gamma radiation or X-rays. A major drawback to electron beam processing, is that the electron beam is only capable of penetrating relatively shallow depths (i.e. cm) into product, especially high density products such as food stuffs. This limitation reduces the effectiveness of electron beam processing of bulk or palletized materials of high density. Gamma radiation is more effective in penetrating products, especially those of a higher density or larger dimensions, compared with electron beam. Most gamma sources are based on radioactive nuclides such as cobalt-60. Kock and Eisenhower (National Research Council of the National Academy of Sciences Publication #1273; 1965) discuss the merits of different types of radiation processing for the purposes of food treatment. The article suggests that photons are the preferred source for treating large product stacks because of the greater ability of photons to penetrate the product.

U.S. Pat. No. 4,845,732 discloses an apparatus and process for producing bremsstrahlung (X-rays) for a variety of industrial applications including irradiation of food or industrial products. An alternate device for the production of X-rays is disclosed in U.S. Pat. No. 5,461,656 which also discloses X-ray irradiation of a range of materials. U.S. Pat. No. 5,838,760 and U.S. Pat. No. 4,484,341 teach a method and apparatus for selectively irradiating materials such as foodstuffs with electrons or X-rays. None of these documents discloses an apparatus or methods to deliver a relatively even radiation dose distribution, especially in large product stacks of high density, so that a low DUR is achieved in treated products.

U.S. Pat. No. 4,561,358 discloses an apparatus for conveying articles within a tote (carrier) through an electron beam. The invention teaches of a carrier that is capable of reorienting its position as the carrier approaches the electron beam. An analogous system is disclosed in U.S. Pat. No. 5,396,074 wherein articles are transported past an electron beam on a process conveyor system. The conveyor system provides for re-orientation of the carrier so that a second side (opposite the first side) of the carrier is exposed to the radiation source. The carrier is further defined in U.S. Pat. No. 5,590,602. A similar electron beam irradiation device is disclosed in U.S. Pat. No. 5,994,706. An apparatus to optimize the dosage of electron beam radiation within a product are given in U.S. Pat. No. 4,983,849. The apparatus includes placing cylindrical or plate dose attenuators between the radiation beam and product. The attenuators comprise a moving, perforated metal plate (or cylinder) scatter the radiation beam and reflect non-intersecting electrons thereby increasing dosage uniformity.

U.S. Pat. No. 5,554,856 discloses a radiation sterilizing conveyor unit for sterilizing biological products, food stuffs, or decontamination of clinical waste and microbiological products. Products are placed on a disk-shaped transporter and rotated so that the products are exposed to a field of accelerated electrons. A similar apparatus for electron beam sterilization of biological products, foodstuffs, clinical waste and microbiological products is also disclosed in U.S. Pat. No. 5,557,109. Products are placed in a recess or pocket of a manipulator which is slid horizontally into a cavity until the products are aligned with a path of an electron beam housed within the sterilization unit.

In the prior art systems described above, there are limitations in the ability to deliver a relatively flat dose distribution (low DUR) throughout a product or product stack since no method is provided to compensate for the different doses received by the exterior and interior portions of the product stack. This therefore results in the outer portions of a product to receive a much higher radiation dose than that received within the product stack.

U.S. Pat. No. 4,029,967 and U.S. Pat. No. 4,066,907 disclose an irradiation device for the uniform irradiation of goods by means of electro-magnetic radiation having a quantum energy larger than 5 KeV. Products to be irradiated (including medical articles, feedstuffs, and food) rotate on turntables and are partially shielded from a radiation source by shielding elements. There is no discussion of optimizing the geometry of the radiation beam relative to the product stack, or modifying the spacing of the shielding elements in order to optimize the DUR within a product. As a result, products with different densities are still subject to a wide range in DUR as is the case with other prior art systems. U.S. Pat. No. 5,001,352, also discloses a similar apparatus comprising product stacks that rotate on turntables, positioned around a centrally disposed radiation source, and shielding elements that reduce lateral radiation emitting from the source. A shielding element comprising a plurality of pipes that are fluid filled thereby permitting flexibility in the form of the shielding element is also discussed. However, there is no guidance as to how this or the other shielding elements are to be positioned in order to attenuate the radiation beam relative to the product stack in order to optimize the DUR within the product. Nor is there any discussion of any real-time adjustment of shielding elements to optimize the dose distribution received by a product that accounts for alterations in product densities.

A major limitation with the prior art irradiation systems is that it is difficult to obtain a relatively even radiation dose distribution (low DUR) throughout a product or product stack. For example, in systems which irradiate products from only one side, the material irradiated at the periphery of the product and closest to the irradiation source receives a high radiation dose relative to the product located at the center regions of the product stack, and further away from the radiation source resulting in a high DUR. Even with systems that irradiate products from multiple sides, the material irradiated at the periphery of the product typically receives a higher dose of radiation than the material located at the centre of the product since the radiation method is not optimized for the product stacks. Consequently, the product receives an uneven dose of radiation, characterised by a high DUR. Thus, prior art systems are limited in their ability to deliver a relatively flat dose distribution (low DUR) throughout a product or product stack. These limitations are more pronounced in larger products, with higher densities.

It is an object of the current invention to overcome drawbacks in the prior art.

The above object is met by the combinations of features of the main claims, the sub-claims disclose further advantageous embodiments of the invention.

SUMMARY OF THE INVENTION

The present invention relates to a method and apparatus for irradiating products to achieve a radiation dose distribution that satisfies specified dose uniformity criteria throughout the product.

According to the present invention there is provided a product irradiator comprising: a radiation source, an adjustable collimator, a turntable; and a control system. The radiation source may be selected from the group consisting of gamma, X-ray and electron beam radiation. Preferably, the radiation source is an X-ray radiation source comprising an electron accelerator for producing high energy electrons, a scanning horn for directing the high energy electrons and a converter for converting the high energy electrons into X-rays.

The present invention is also directed to the product irradiator as defined above which further comprises a detection system. The detection system measures at least one the following parameters: transmitted radiation, instantaneous angular rotation velocity of the turntable, angular orientation of the turntable, power of the radiation beam, energy of the radiation beam, speed of vertical scan, collimator aperture, width of the radiation beam, position of an auxiliary shield, offset of the radiation beam axis from axis of rotation of the product on the turntable, distance of the turntable from collimator, and distance of collimator from the source. Preferably, the detection system is operatively linked with said control system.

The present invention also pertains to a method of radiation processing a product comprising:

i) determining length, width, height and density of a product stack comprising the product;

ii) determining the width of a collimated radiation beam required to produce a low Dose Uniformity Ratio within the product;

iii) adjusting a collimator aperture to obtain the width determined in step ii); and iv) rotating the product stack within the collimated radiation beam for a period of time sufficient to achieve a minimum required radiation dose within the product.

This method also pertains to the step of adjusting (step iii), wherein an angular velocity of the turntable may be adjusted. Furthermore, within the step of adjusting, the collimated radiation beam is a collimated X-ray beam produced from high energy electrons generated by an electron accelerator, and power of the high energy electrons may be adjusted.

This invention also pertains to the method as defined above wherein during or following the step of rotating, is a step (step v) of detecting X-rays transmitted through the product. Furthermore, during or following the step of detecting (step v), is a step (step vi) of processing information obtained in the detecting step by a control system and altering, if required, of any of the following parameters: collimator aperture, distance between the turntable and collimator, turntable offset, position of auxiliary shield, angular velocity of the turntable, power of the high energy electrons, speed of vertical scan.

The present invention also pertains to the use of an apparatus comprising a radiation source for producing radiation energy selected from the group consisting of x-ray, e-beam, and radioisotope, an adjustable collimator capable of attenuating a first portion of the radiation while permitting passage of a second portion of the radiation, the second portion of radiation shaped by the adjustable collimator into a radiation beam, the radiation beam traversing a turntable capable of receiving a product stack, and a control system capable of modulating the adjustable collimator or any one or all irradiation system parameters as the product stack rotates on the turn-table, for delivery of a radiation dose producing a low dose uniformity ratio (DUR) within the product stack The present invention further pertains to a method of irradiating a product stack with a low dose uniformity ratio comprising, rotating a product stack in an X-ray radiation beam of width less than or equal to the diameter of the product stack and modulating the width of the radiation beam relative to the rotating product stack. Modulation of the width of the radiation beam may be effected by adjusting the adjustable collimator, the distance between the product stack and collimator, or the distance between the source and collimator, position of an auxiliary shield, or a combination thereof, as the product stack rotates in the radiation beam.

The present invention is directed to a product irradiator comprising:

i) an X-ray radiation source essentially consisting of an electron accelerator for producing high energy electrons, a scanning horn for directing the high energy electrons towards a convertor, the converter for converting said high energy electrons into X-rays to produce an X-ray beam, the X-ray beam directed towards a product requiring irradiation;

ii) an adjustable collimator for shaping the X-ray beam;

iii) a turntable upon which the product is placed; and iv) a control system in operative communication with the electron accelerator, the adjustable collimator and the turntable.

This invention also pertains to the product irradiator just defined further comprising a detection system in operative association with the control system. Furthermore, the turntable of the product irradiator may be movable towards or away from the adjustable collimator, or the turntable my be movable laterally, so that an axis of rotation of the product on the turntable is laterally offset from the X-ray beam axis. The product irradiator may also comprising an auxiliary shield.

The present invention also pertains to the the product as defined above, wherein the detection system measures at least one the following parameters: transmitted X-ray radiation, instantaneous angular velocity of the turntable, angular orientation of the turntable, power of the high energy electrons, width of high energy electron beam, energy of the X-ray beam, aperture of the adjustable collimator, position of the auxiliary shield, offset of the radiation beam axis from axis of rotation of the turntable, distance of the turntable from collimator, and distance of the collimator from the radiation source.

The present invention also pertains to an apparatus for irradiating a product comprising:

i) a radiation detection system that measures the amount of radiation absorbed by at least part of the product;

ii) a radiation source;

iii) a collimator, and iv) a turntable.

wherein each of the source, collimator and turntable have at least one parameter that is capable of being adjusted automatically based upon a measurement made by the detection system to achieve a low Dose Uniformity Ratio in a product during irradiation.

The present invention embraces a medium storing instructions adapted to be executed by a processor to modulate either:

i) the width of a collimator while a product is being rotated by a turntable, and irradiated by a radiation beam, wherein the radiation beam is collimated by the collimator;

ii) the intensity of a radiation beam while a product is being rotated by a turntable, and irradiated by the radiation beam;

iii) the rate of rotation of a turntable table, while a product is being irradiated by the radiation beam; and iv) optionally, modifying the vertical scan speed.

The present invention also provides for a system for irradiating a product comprising;

i) means for producing a radiation beam;

ii) means for measuring the amount of radiation absorbed by at least part of the product;

iii) means for adjustably setting the width of the radiation beam that irradiates the product;

iv) means for rotating the product;

v) means for modulating the rate of rotation of the product, modulating the adjustable width of the radiation beam during irradiation based upon the measured amount of radiation absorbed by at least a part of the product.

Furthermore, the present invention relates to the system described above further comprising means for modulating intensity of the radiation beam based upon the measured amount of radiation absorbed by at least part of the product.

This summary of the invention does not necessarily describe all necessary features of the invention but that the invention may also reside in a sub-combination of the described features.

BRIEF DESCRIPTION OF THE DRAWINGS

These and other features of the invention will become more apparent from the following description in which reference is made to the appended drawings wherein:

FIGS. 1(*a*) and 1(*c*) illustrate a two dimensional side view of a rectangular product of uniform density irradiated from a single side by a uniform radiation beam. FIGS. 1(*b*) and (*d*) depicts the radiation dose delivered to the product irradiated according to FIGS. 1(*a*) and (*c*), respectively. FIG. 1(*e*) illustrates a two dimensional view of a rectangular product of uniform density irradiated from opposite sides by a uniform radiation beam. FIG. 1(*f*) depicts the radiation dose delivered in the product irradiated as in FIG. 1(*e*); "▲" denotes the dose distribution curve received along the right hand side of the product stack; "■" denotes the dose distribution curve received along the left hand side of the product stack; "◆" denotes the sum of the dose within the product.

FIG. 2(*a*) illustrates a two dimensional view of a cylindrical product irradiated with a radiation beam of width greater than or equal to the diameter of the product. FIG. 2(*b*) illustrates a typical radiation dose delivered in the cylindrical product irradiated as in FIG. 2(*a*) as a function of position along the center line. FIG. 2(*c*) illustrates a two dimensional view of a cylindrical product irradiated with a narrow radiation beam passing through the centre axis of the product. $R_1$ and $R_2$ denote points or volume elements in the product which are offset from the centre of the product. Rotational axis of the product cylinder is parallel to the vertical center line of the beam. FIG. 2(*d*) represents a typical radiation dose delivered in the product, irradiated as in FIG. 2(*c*) as a function of position along line X–X'. FIG. 2(*e*) illustrates a two dimensional view of a cylindrical product in a radiation beam of optimal width for the diameter and density of the product. FIG. 2(*f*) represents a typical radiation dose delivered in the product, irradiated as in FIG. 2(*e*) as a function of position along line X–X', displaying a relatively even radiation dose distribution curve yielding a low DUR in the product along diameter X–X'.

FIG. 3(*a*) shows a top view of an irradiation apparatus depicting a shallow collimator profile. FIG. 3(*b*) shows a top view of an irradiation apparatus depicting a tunnel collimator. FIG. 3(*c*) shows a top view of the apparatus with an offset collimator directing the radiation beam preferentially to one side of the product, in this embodiment the radiation beam axis is offset from the axis of rotation of the turntable,. FIG. 3(*d*) shows a top view of the apparatus with a moveable auxiliary shield placed in the path of the radiation beam. In this figure, the wedge is positioned in approximate alignment with the collimator. FIG. 3(*e*) shows a typical radiation dose distribution delivered within a product resulting from a constant speed of vertical scan (solid line) and a variable speed of vertical scan, where the duration of the scan is increased at the upper and lower regions of the product (dashed line).

FIG. 8(*a*) shows a layout of a conveyor system integrated with the radiation processing system, as described herein, for delivery and removal of product stacks. FIG. 8(*b*) shows a flow chart outlining a process of the present invention. Product characterisation (note 1) may be based on a determination of weight and dimensions, or a diagnostic scan, for example, on CT technology, to determine the exact mass distribution throughout the product. Processing protocol (note 2) may be based on product characteristics, desired dose and a library of parameter control functions. FIG. 8(*c*) shows a process control flow chart identifying parameters, both inputs and outputs, that may be considered for generating a processing protocol (note 2, FIG. 8(*b*)), and the relationship between these parameters.

FIG. 10(*a*) shows the dose profile for a product with a density of 0.2 g./cm$^3$, for three beam widths, 10, 50 and 120 cm. FIG. 10(*b*) shows the dose profile for a product with a density of 0.8 g./cm$^3$, for three beam widths, 10, 50 and 120' cm.

FIG. 11(*a*), shows the depth profile for a 60 cm product radius. FIG. 11(*b*) shows the depth profile for a 80 cm product radius. FIG. 11(*c*) shows a summary of results over a range of collimator aperture widths that produce an optimized DUR, for products of increasing radius.

FIG. 12(*a*) shows 8 stepped collimator aperture widths over a 90° rotation of the product stack, as well as the idealized calculated aperture width to optimize DUR within a rotating, rectangular product (using a 1 mm Ta convertor, see example 2 for details). Starting with the 100 cm long side facing the beam, these adjustments are mirrored and repeated for the remaining 270° of product rotation. FIG. 12(*b*) shows 26 stepped collimator aperture widths over a 90° rotation of the product stack, as well as the idealized calculated aperture width to optimize DUR within a rotating, rectangular product (using a 2.35 mm Ta convertor, see Example 3). These adjustment are mirrored and repeated for the remaining 270° of product rotation. FIGS. 12(*c*) and 12(*d*) shows stepped adjustments to the power of the radiation beam over a 90° rotation of the product stack. These adjustments in beam power are mirrored and repeated over the remaining 270° of product rotation.

FIG. 13(*b*) shows an example of the dose distribution within a product exposed to a radiation beam modified by placing various thicknesses of an auxiliary shield in the beam path.

FIG. 14(*a*) shows changes in aperture as a function of product rotation over 360°. FIG. 14(*b*) shows changes in beam power as a function of product rotation over 360°. FIG. 14(*c*) shows the dose distribution profile with a product exposed to a radiation beam that is offset from the center of the product by 5° (7 cm from product center). The different "Y" values represent the depth-dose profiles determined at various cross sections of the product (see Example 5).

DESCRIPTION OF PREFERRED EMBODIMENT

The present invention relates to a method and apparatus for irradiating products to achieve a radiation dose distribution that satisfies specified dose uniformity criteria throughout the product.

The following description is of a preferred embodiment by way of example only and without limitation to the combination of features necessary for carrying the invention into effect.

Figure 1A:
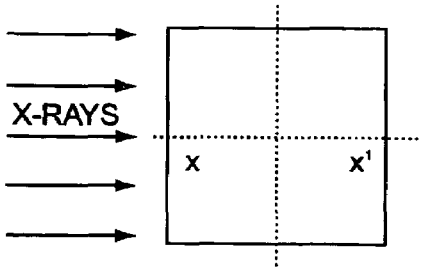
FIG. 1 depicts typical radiation dose distribution-depth curves for products irradiated from a single side or multiple sides as is currently done in the art.
Figure 1B:
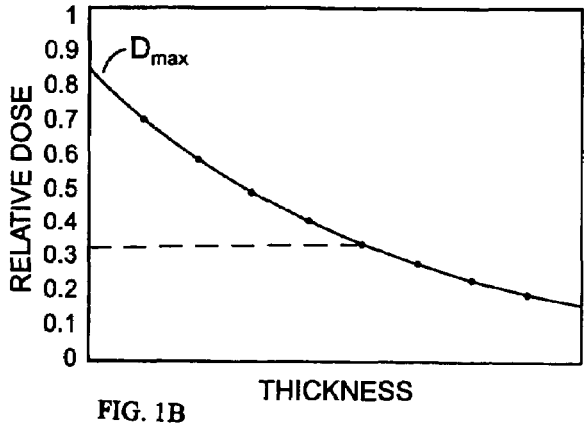
Figure 1C:
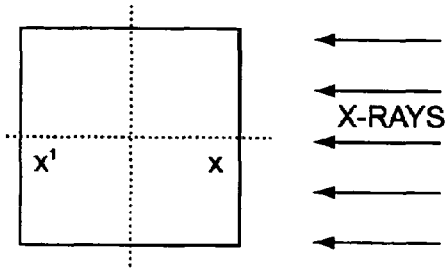
Figure 1D:
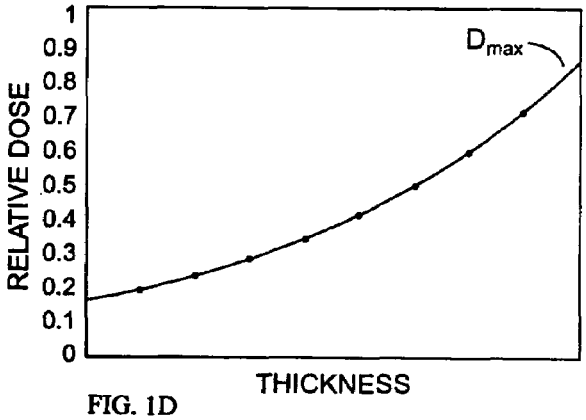
Figure 1E:
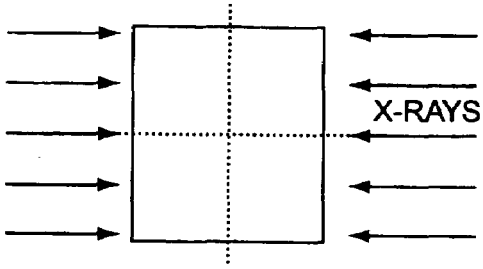
Figure 1F:
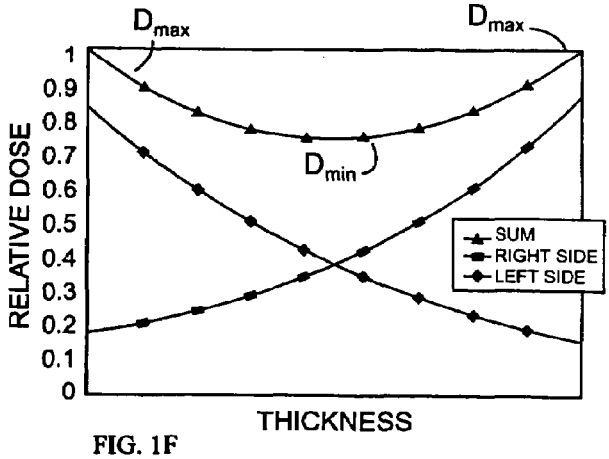
Figure 2A:
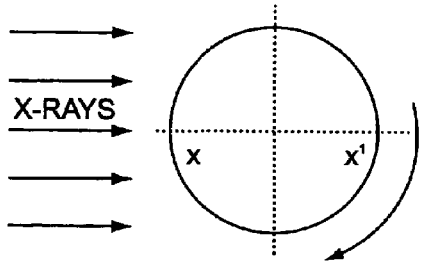
FIG. 2 depicts the radiation dose distribution-depth curves delivered in cylindrical products of uniform density which have undergone rotation in a radiation beam.
Figure 2B:
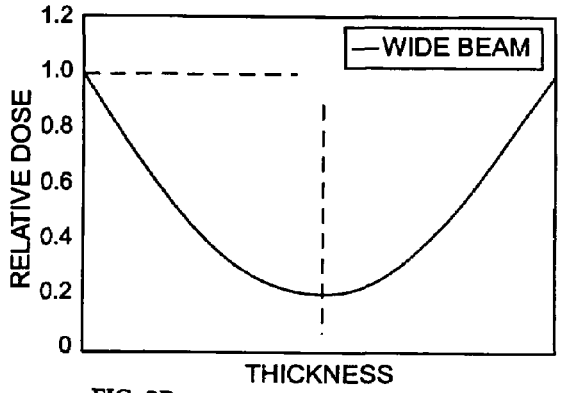
Figure 2C:
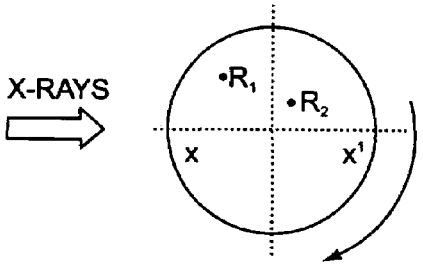
Figure 2D:
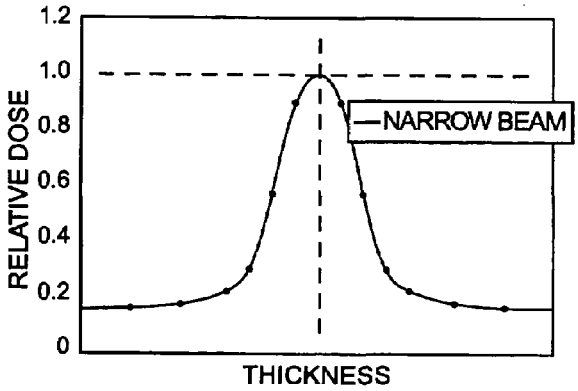
Figure 2E:
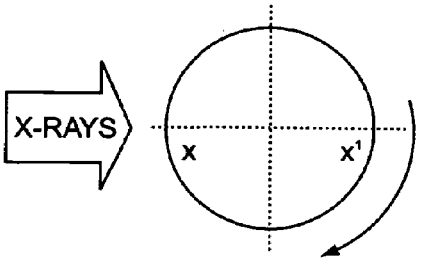
Figure 2F:
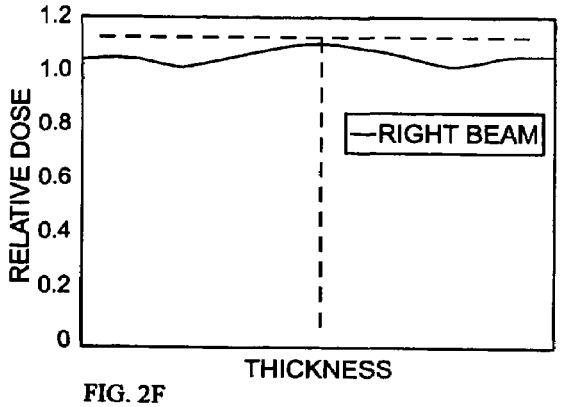
Figure 3A:
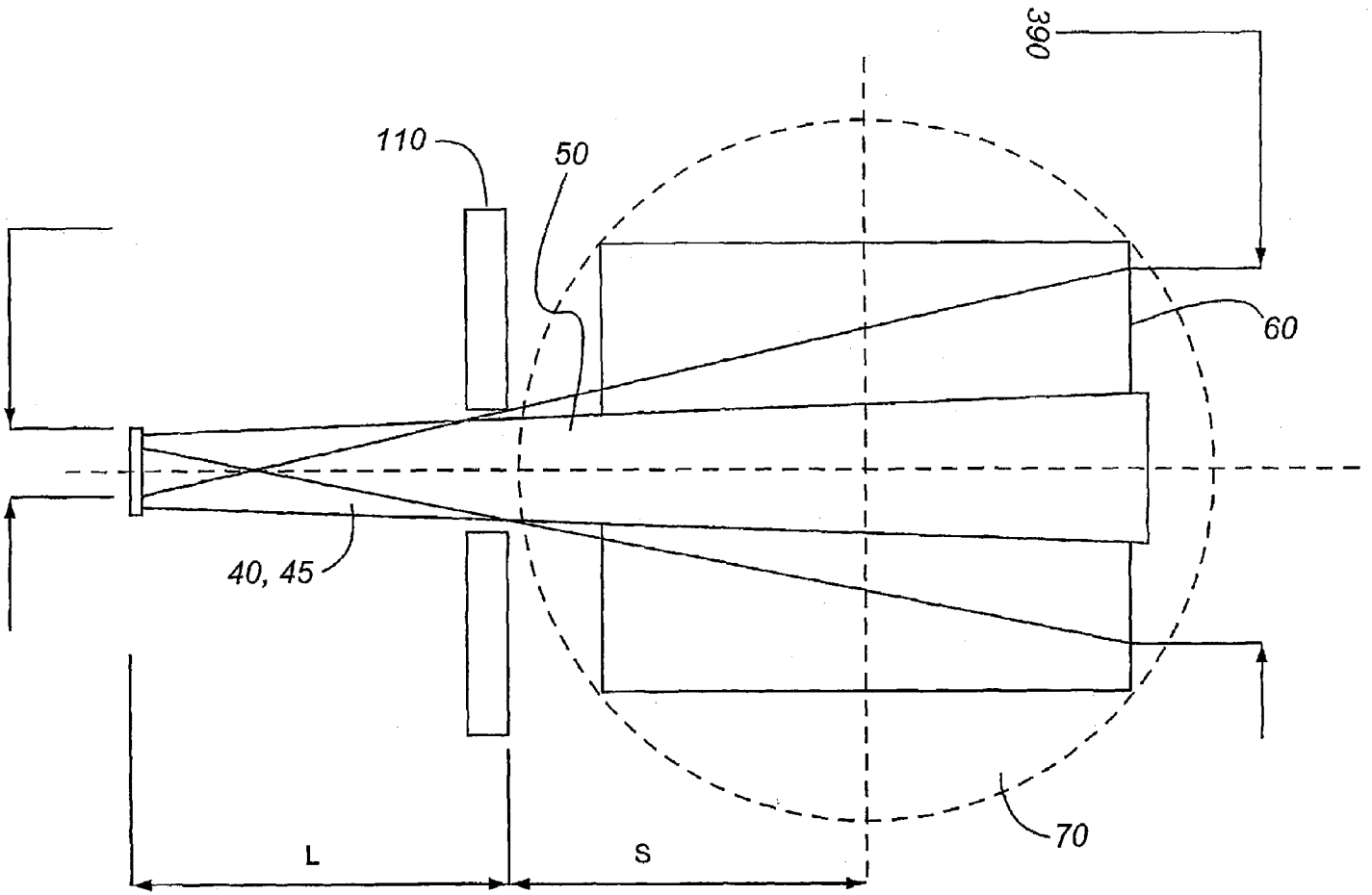
FIG. 3 shows several aspects of the present invention depicting the relationship between the radiation beam, aperture and product. Several of the parameters which must be considered for delivering a relatively even radiation dose distribution (low DUR) in a product or product stack are indicated (see disclosure for details).
Figure 3B:
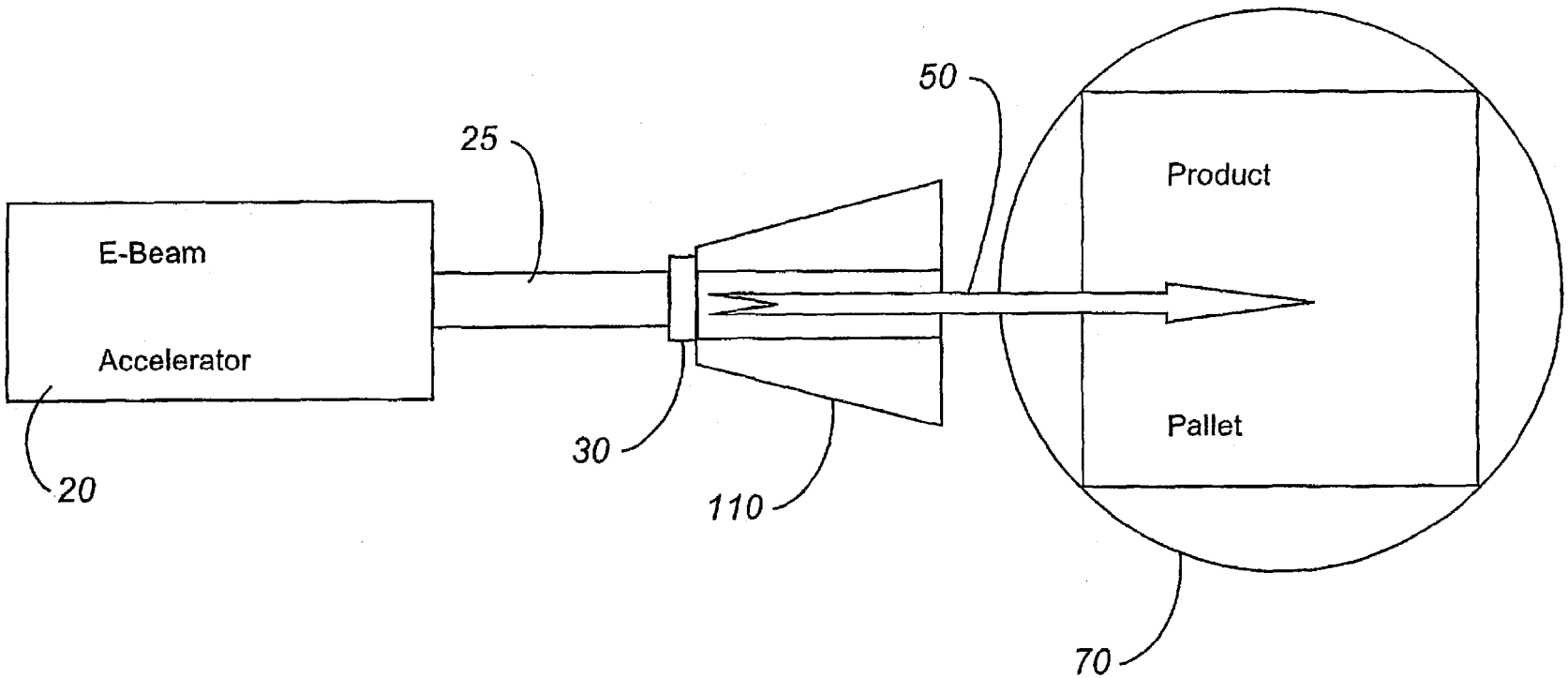
Figure 3C:
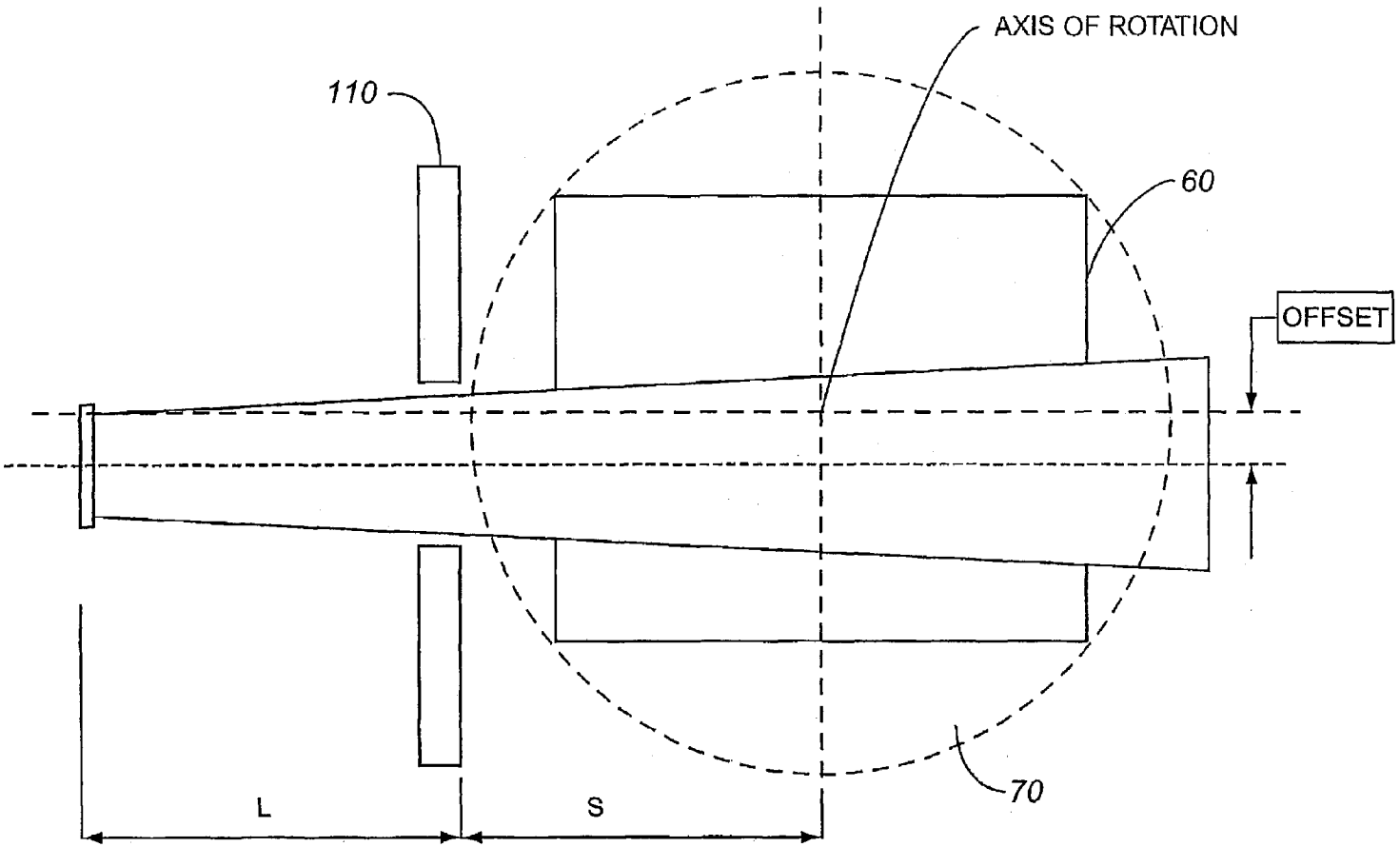
Figure 3D:
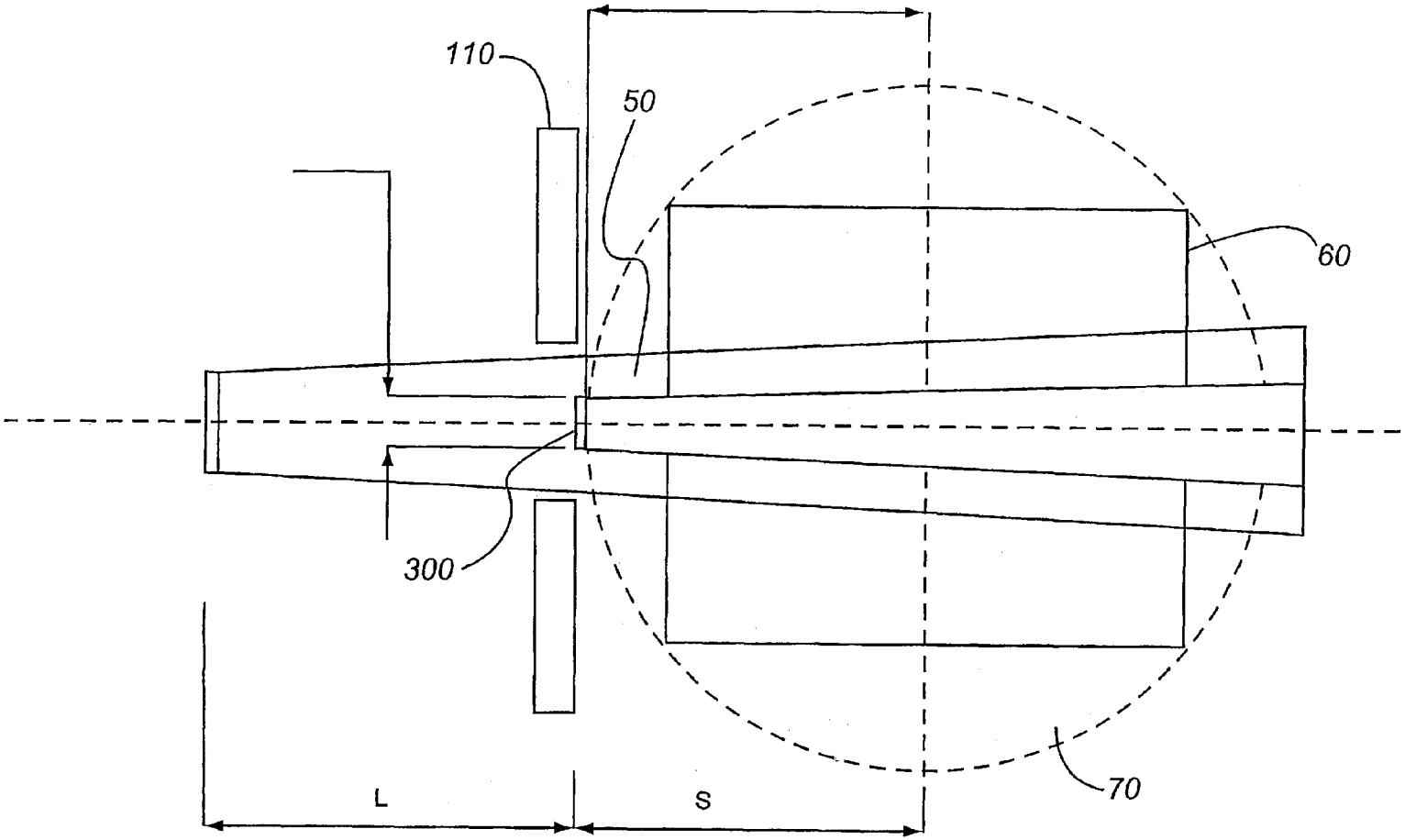
Figure 3E:
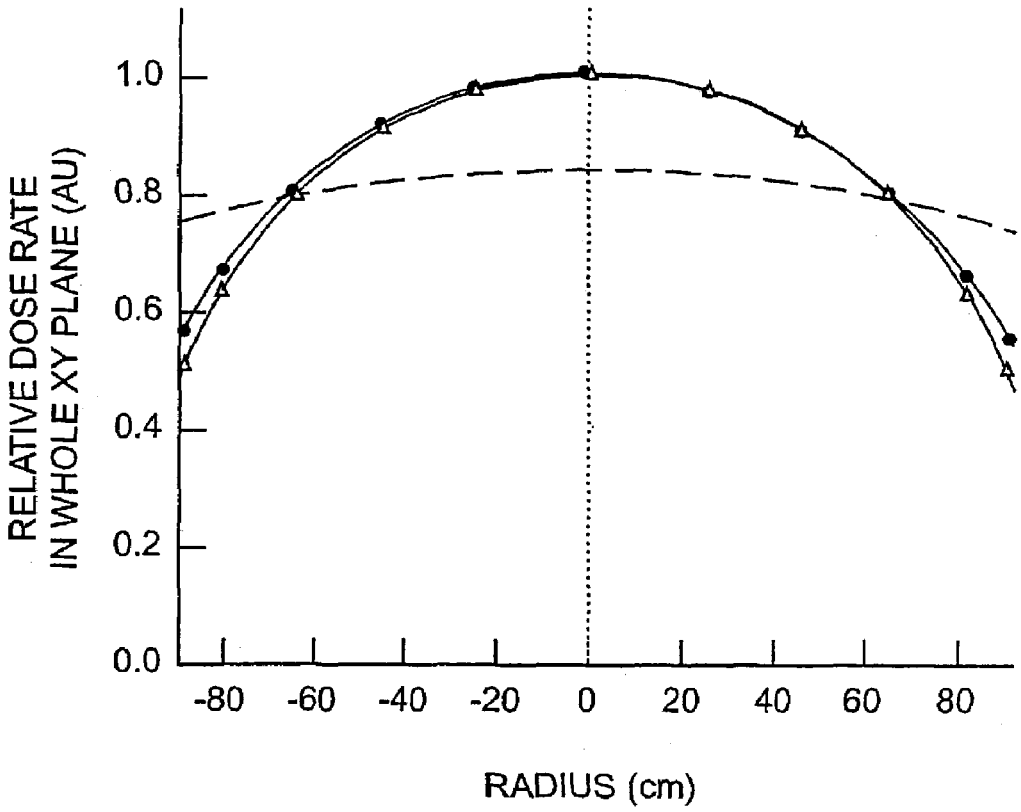
Figure 4:
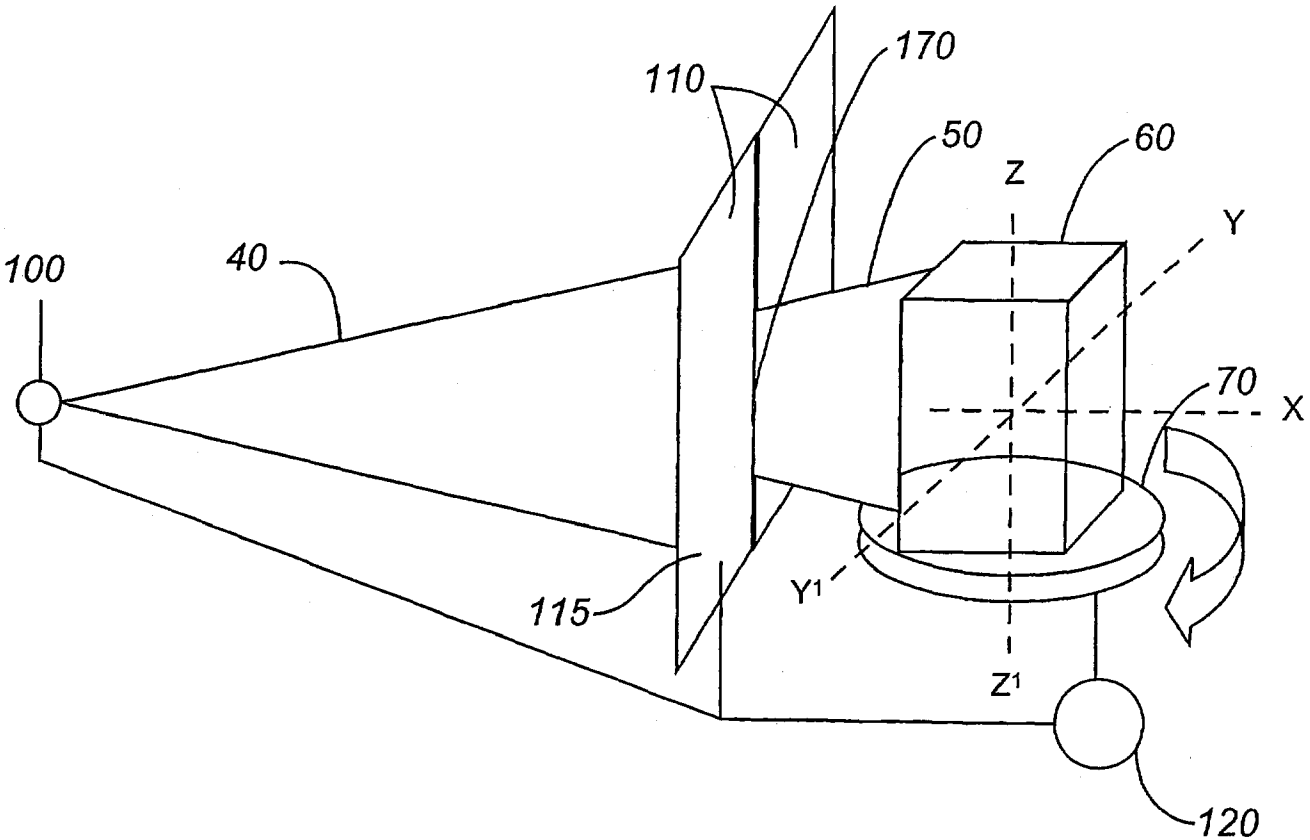
FIG. 4 depicts an aspect of the current invention showing the shaping of the radiation beam as it passes through a collimator, and a rotating product stack irradiated with the collimated radiation beam.
Figure 5:
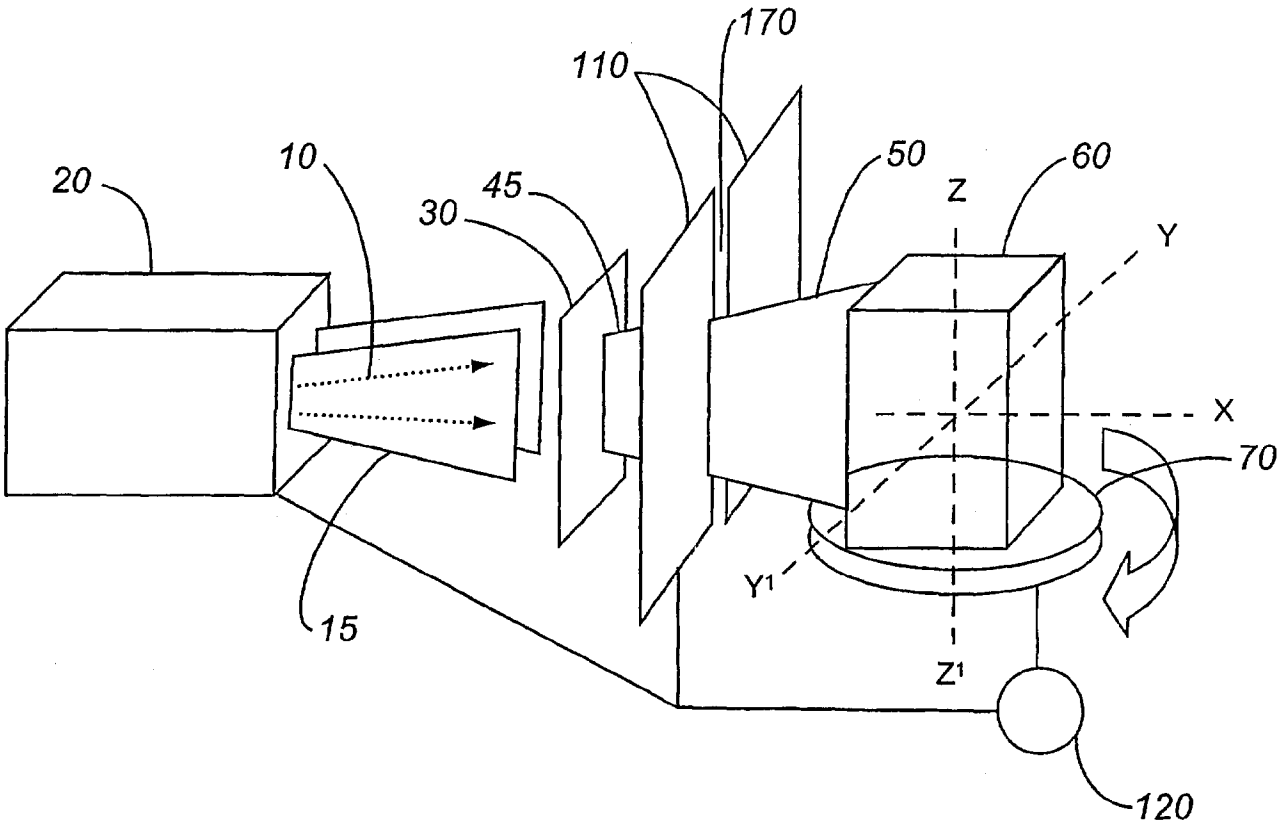
FIG. 5 depicts an aspect of the invention wherein an accelerator is employed to produce an X-ray beam for irradiation of a rotating product stack.
Figure 6:
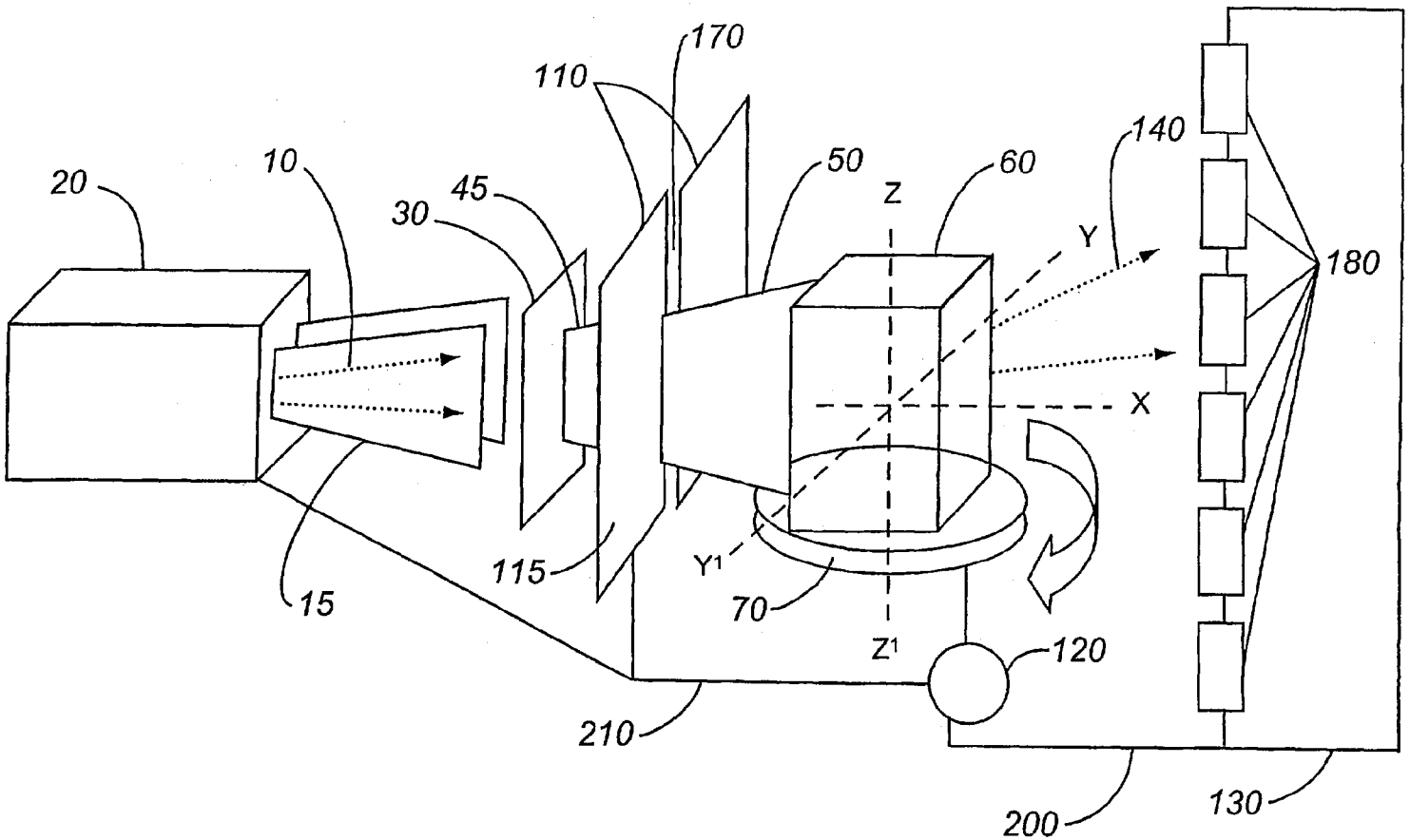
FIG. 6 illustrates an aspect of the invention wherein one or more radiation detector units integrated with a control system, is capable of controlling a variety of radiation processing parameters.

By "radiation processing" it is meant the exposure of a product, or a product stack (60) to a radiation beam (40; FIG. 4; or 45; FIG. 5) or a collimated radiation beam (50; FIGS. 4 to 6). The product must be within the radiation chamber (80), and the radiation source must be placed into position and unshielded as required to irradiate the product, for example as in the case of but not limited to a radioactive source (100; for example the radioactive source that is raised from a storage pool), or the radiation source must be in an active state, for example when using an electron-beam (15), or X-rays derived from an electron beam (e.g. 45; FIG. 5) in order to irradiate the product or product stack (60). It is to be understood that any product may be processed according to the present invention, for example, but not limited to, food products, medical or laboratory supplies, powdered goods, waste, for example biological wastes.

By the term "dose uniformity ratio" or "DUR" it is meant the ratio of the maximum radiation dose to the minimum radiation dose, typically measured in Grays (Gy) received within a product or product stack, and is expressed as follows:

$$DUR_1 = Dose_{max}/Dose_{min}$$

$Dose_{max}$ (also referred to as $D_{max}$) is the maximum radiation dose received at some location within the product or product stack in a given treatment, and $Dose_{min}$ is the minimum radiation (also referred to as $D_{min}$) dose received at some location within the same product or product stack in a given treatment.

A DUR of 2 indicates that the highest radiation dose received in a volume element located somewhere within the product stack is twice the lowest radiation dose delivered in a volume element located at a different position within the same product or product stack. A DUR of about 1 indicates that a uniform dose distribution has been delivered throughout the product material. A "high DUR" is defined to mean a DUR greater than about 2. A "low DUR" is defined to mean a DUR of about 1 to less than about 2. These are arbitrary categories. Conventional irradiation systems are characterized as producing a high DUR of above 2 for low density products, and above 3 for products with densities greater than or equal to 0.8 g./cm$^3$.

By the term "accelerator" (20; FIG. 5) it is meant an apparatus or a source capable of providing high energy electrons preferably with energy and power measured in millions of electron volts (MeV) and in kilowatts (kW) respectively. The accelerator also includes associated auxiliary equipment, such as a RF generator, Klystron, power modulation apparatus, power supply, cooling system, and any other components as would be known to one skilled in the art to generate an electron beam.

By the term "scanning horn" it is meant any device designed to scan a beam of high energy electrons over a specified angular range. The dimensions may include a horizontal or a vertical plane of electrons. The scanning horn may comprise a magnet, for example, but not limited to a "bowtie" magnet, to produce a parallel beam of electrons emitting from the horn. Also, the "scanning horn" may be an integral part of the accelerator or it may be a separate part of the accelerator.

By the term "converter" (30; FIG. 5) it is meant a device or object designed to convert high energy electrons (10, 15) into X-rays (45; FIG. 5).

By the term "collimator" or "adjustable collimator" (110) it is meant a device that shapes a radiation beam (40, 45) into a desired geometry (50). Typically the shape of the radiation beam is adjusted in its width, however, other geometries may also be adjusted, for example, but not to be considered limiting, its height or both its height and width, as required. It is also contemplated that non-rectangular cross-sections of the beam are also possible. The collimator defines an aperture through which radiation passes. The collimator may have a shallow profile as depicted in FIG. 3(*a*), or may have an elongated profile as depicted in FIG. 3(*b*). An elongated collimator, such as that shown in FIG. 3(*b*) helps focus the radiation beam by altering the penumbra. Adjustments to the aperture of the collimator shape the radiation beam into the desired geometry and dimension required to produce a DUR approaching 1 for a product stack with particular characteristics (such as geometry and density).

By the term "adjustable collimator" it is meant a collimator with an adjustable aperture that shapes the radiation beam into any desired geometry, for example, but not limited to adjusting the height, width, offset of the beam axis from the axis of rotation of the turntable, or a combination thereof, before or during radiation processing of a product or product stack. For example, an adjustable collimator may comprise a two or more radiation opaque shielding elements (for example, 115), that move horizontally thereby increasing or decreasing the aperture of the collimator as required. Shielding elements other than that shown in FIGS. 4 to 6 may also be used that adjust the aperture of the collimator. For example, which is not to be considered limiting, the shielding elements may comprise a plurality of overlapping plates each being radiation opaque, or partially radiation opaque, and capable of moving independently of each other. The overlapping plates may be moved as required to adjust the opening of aperture 170 (see Examples 2 and 3 for results relating to optimizing DUR by adjusting aperture width of collimator). The shielding elements may also comprise, which again is not to be considered as limiting, a plurality of pipes (e.g. U.S. Pat. No. 5,001,352; which is incorporated herein by reference) each of which may be independently filled, or emptied, with a radiation opaque substance. The filling or emptying, of the pipes adjusts the effective width of the collimator aperture as required.

By "auxiliary shield" it is meant a device that partially blocks the radiation beam and is placed within the radiation beam, between the converter and product stack (see 300, FIGS. 3(*d*) and 13(*a*), Example 4). The auxiliary shield helps to further shape the radiation beam, regulate penumbra, and reduce the dose at the center of the radiation beam within the product stack The auxiliary shield may be movable along the axis of the radiation beam so that it may be variably positioned in the path of the radiation beam, between the converter and product stack. Auxiliary shields that are appropriately shaped, and that may span the entire collimator aperture are also effective in reducing DUR, for example, but not limited to those shown in FIG. 13(*a*).

By the term "detection system" (130) it is meant any device capable of detecting parameters of the product stack before, and during radiation processing. The detection system may comprise one or more detectors, generally indicated as 180 in FIG. 6, that measure a range of parameters, for example but not limited to, radiation not absorbed by the product. If measuring transmitted radiation, such detectors are placed behind the product to measure the amount of radiation transmitted through the product stack. However, detectors may also be placed in different locations around the product, or elsewhere so that other non-absorbed radiation is monitored. Other detectors may also be used to determine parameters before, or during radiation processing, including but not limited to those that measure the position of rotation of the turntable (angular orientation), instantaneous angular velocity of the turn table, collimator aperture, product density, product weight, product stack dimensions, energy and power of the electron beam, and other parameters associated with the conveying system or geometry of the system arrangement.

Figure 7:
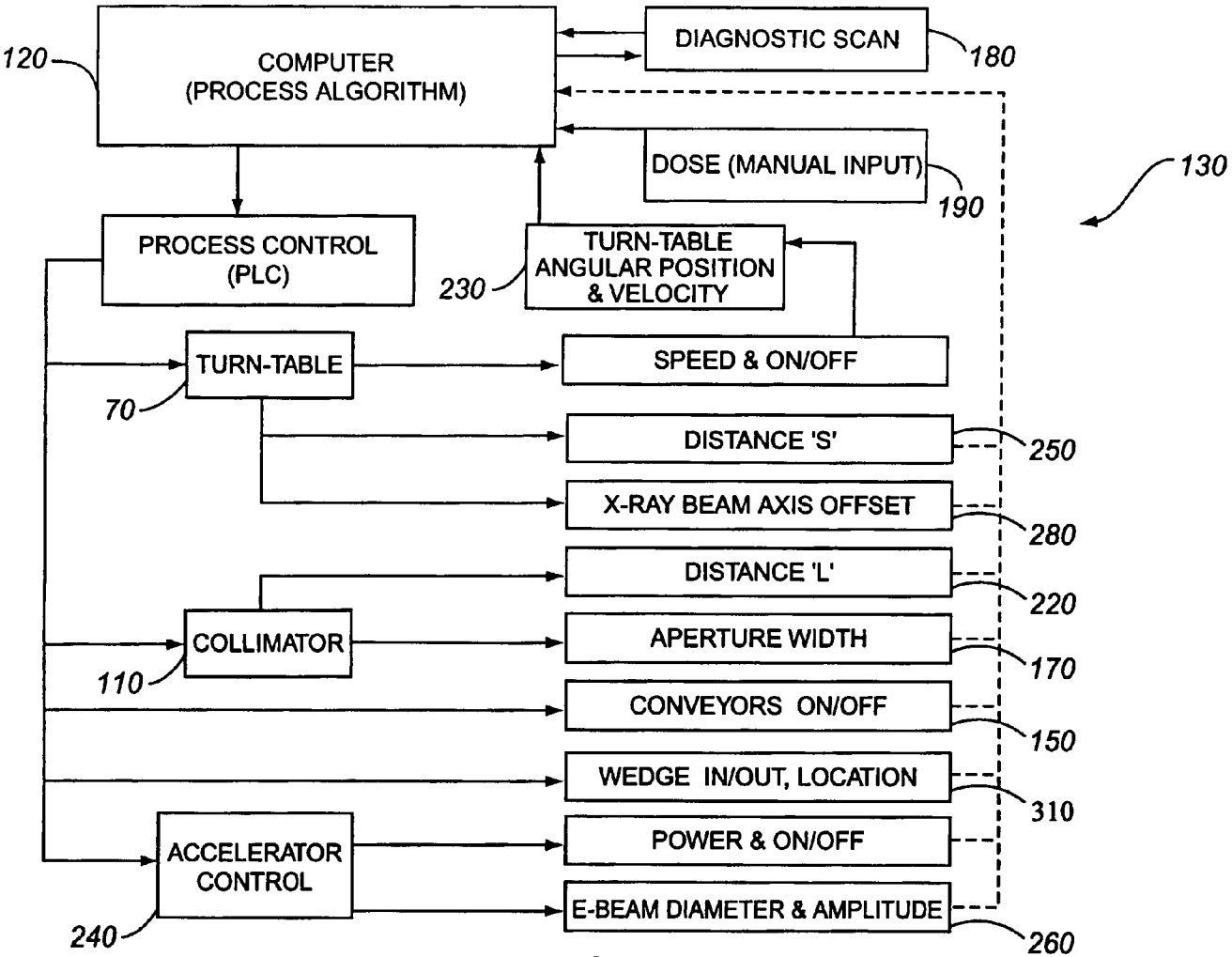
FIG. 7 depicts a schematic arrangement of the control system of the present invention.

A control system, generally indicated as 120 in FIG. 7, is used to receive the information obtained by the detector system (130) to either maintain the current system settings, or adjust one or more components of the irradiation system of the present invention as required (see FIG. 6). These adjustments may take place before, or during radiation processing of a product. Components that are monitored by the control system (120), and that may be adjusted in response to information gathered by the detector system (130) include, but are not limited to, the size of aperture (170, i.e. the beam geometry), power of the radiation beam (45), energy of the radiation beam (15), speed of rotation of the turntable (70), angular position (orientation) of turntable (230), instantaneous angular velocity of the turntable, distance of the collimator from the source ('L', FIG. 3(*a*); 220, FIG. 7), distance of the turntable from the collimator ('S', FIG. 3(*a*); 250, FIG. 7), and conveying system (150). In this manner, the control system (120) uses parameters derived from characteristics obtained from the detector system (130) in order to optimize the radiation dose distribution delivered to the product stack (60). The control system includes, in addition to the detection system (130), hardware and software components (120) required to process the information obtained by the detector system, and the interfacing (200, 210) between the computer system (120) and the detector system (interface 200), and the elements of the radiation system (interface 210).

Theory for Optimizing DUR within a Product Stack

FIG. 1, illustrates the radiation dose profiles within a product that has been exposed to irradiation from either one or two sides which are common within the art. for example, irradiation processes involving one side are disclosed in U.S. Pat. Nos. 4,484,341; 4,561,358; 5,554,856; or 5,557,109. Similarly, two-sided irradiation of a product is described in, for example, U.S. Pat. Nos. 3,564,241; 4,151,419; 4,481,652; 4,852,138; or 5,400,382.

Shown in FIGS. 1(*a*) and (*c*) are two dimensional representations of the irradiation of a product stack from a single side with a uniform radiation beam. The radiation dose delivered through the depth of the product along line X–X' of FIGS. 1(*a*) and (*c*) is represented in FIGS. 1(*b*) and (*d*), respectively. The dose response curve decreases with distance from the product surface nearest the source to a minimum level ($D_{min}$) at the opposite side of the product, With one sided radiation processing the DUR ($D_{max}/D_{min}$) is much greater than 1. 'D' represents the minimum radiation dose required within the product for a desired specific effect, for example but not limited to, sterilization. A portion Of the product has not reached the minimum required dose in FIG. 1(*b*) therefore a longer irradiation period is required for all of the product to reach at least the minimum required dose (D). This results in over exposure of the product on the side facing the radiation source and this is undesirable for the processing of many products that are modified as a result of exposure to excessively high doses of radiation.

Similar modeling for two sided irradiation of a product is presented in FIGS. 1(*e*) and (*f*). Under this radiation processing condition two sides of the product receive a high radiation dose, relative to the middle of the product. Two sided irradiation still results in a relatively high DUR in the product, but the difference between $D_{max}$ and $D_{min}$ is reduced, and the DUR is improved when compared to one-sided irradiation.

FIG. 2(*a*), illustrates a two dimensional view of the irradiation of a product rotating about its axis in a uniform radiation field where the width of the radiation beam is greater than or equal to the diameter of the product. The product for simplicity is depicted as having a circular cross section, however, rectangular products, or irregularly shaped products may also be rotated to produce similar results as described below.

Shown in FIG. 2(*b*) is the corresponding radiation dose profile received by the product shown along line X–X'. Under these conditions, the radiation dose distribution delivered in the product along X–X' approximates the radiation dose distribution delivered to the product in two-sided radiation (also along X–X'; FIG. 1(*e*)) resulting in relatively high DUR.

If a rotated product is irradiated using a radiation beam that is much narrower than the diameter (or maximum width) of the product, and which passes through the centre of the product as shown in FIG. 2(*c*), then the radiation dose distribution curve along X–X' is relatively low at the periphery of the product and much greater at the centre of the product (see FIG. 2(*d*)). In such a case, the centre of the product is always within the radiation beam, whereas volume elements such as those defined by points $R_1$ and $R_2$ (FIG. 2(*c*)) only spend a portion of time in the radiation beam. This fractional exposure time is a function of 'r' (FIG. 3(*a*)) and beam width ('A', FIG. 3(*a*)). The beam width can be controlled in order to control fractional exposure time and hence dose within the product. The fractional exposure time may also be controlled by offsetting the beam from the central axis of rotation of the product (see FIG. 3(*c*)).

Both radiation dose distribution curves (FIGS. 2(*b*) and (*d*)) exhibit large differences between $D_{max}$ and $D_{min}$ and the DUR of these products is still much greater than 1. However, by using a radiation beam wider than the product, or a radiation beam much narrower than the product, the dose distribution profile within the product can be inverted. Therefore, an optimal radiation beam dimension relative to a rotating product such as that shown in FIG. 2(*e*) can be determined, which is capable of irradiating a rotating product and producing a substantially uniform dose throughout the product with a DUR approaching 1 (FIG. 2(*f*)). It is also to be understood that by varying the diameter of the incident radiation beam, for example, by altering the width of the scanning pattern, that the penumbra (390) of the beam may be altered. Typically by increasing the beam width, the penumbra also increases (see FIG. 3(*a*)).

The primary beam intensity and penumbra may also be modulated by placing an auxiliary shield (300) between the converter and product (e.g. FIG. 3(*d*)). Auxiliary shields may block X-ray transmission, or be partially translucent with respect to the transmission of X-rays, for example shields may comprise, but are not limited to, Al or Ta (see Example 4). Furthermore, the auxiliary shield may comprise a variety of shapes, for example, but not limited to shields having a circular, rectangular or triangular cross section, and may span a variety of widths of the aperture (examples of shapes of auxiliary shields are provided in FIG. 13(*a*)). By inserting an auxiliary shield in the path of the X-ray beam, the central region with a product receives a lower dose, lowering the DUR. Without wishing to be bound by theory, a Ta auxiliary shield may filter the X-ray beam and only permit X-rays of high energy to enter the product (i.e. harden the X-ray spectrum).

Another method for altering the dose received within the product is to offset the position of the radiation beam axis with respect to the product axis of rotation (FIG. 3(*c*)). In this arrangement, a portion of the product is always out of the radiation beam as the product rotates, while the central region of the product receives a continual, or optionally reduced, radiation dose. An example of offset of about 7 cm from the center of rotation, which is not to be considered limiting in any manner, is provided in Example 5. Using an offset, a DUR of 1.4 to about 1.2 may be obtained.

The optimal beam dimension must also account for other factors involved during radiation processing, for example but not limited to, product density, the size of aperture (170, i.e. the beam geometry), power of the radiation beam (45), energy of the radiation beam, vertical scan speed as a function of vertical position (instantaneous vertical scan speed), speed of rotation of the turntable (70), angular position (orientation) of turntable (230), instantaneous angular velocity of the turntable, distance of the collimator from the source ('L'; 220), and distance of the turntable from the collimator ('S'; 250; also see FIG. 7).

Irradiation Parameters Affecting DURs in Products

As indicated above, the ratio of the radiation beam width, as determined by the aperture (A), to the width (or diameter) of the product (r) is an important parameter for obtaining a low DUR within a product. As shown in FIG. 2(*d*), for products of uniform density, the smaller the ratio of A/r, the higher the accumulated dose is at the centre of the stack relative to that at the periphery. Conversely, the larger the ratio of A/r, the accumulated dose is greater at the stack periphery (FIG. 2(*b*)). In the case of a cylindrical product, the optimum ratio of A/r, producing the lowest DUR within the product, can be constant (FIG. 2(*f*)). However, in the case of a rectangular product, such as is found in most pallet loads, the effective principal dimension is a function of its angular position (*) with respect to the beam, since the width of the product changes as the product rotates. Therefore, to maintain an optimal DUR within the product, the ratio of A/r is adjusted as required. For example the Air ratio may be determined for a product of known size and density, so that 'A' is set for an average 'r'. This determination may be made based on knowledge of the contents, density and geometry of the product (or tote), and this data entered into the system prior to radiation processing, or it may be determined from a diagnostic scan (see below; e.g. FIG. 6) of a product prior to radiation processing. It is also contemplated that the A/r ratio may be modulated dynamically as a rectangular product rotates in the radiation beam. The A/r ration may be adjusted by either modifying the aperture (170) of the collimator (110), by adjusting the diameter of the beam (i.e. adjusting beam width, and modulating penumbra), by moving shielding elements 115 appropriately, by placing an auxiliary shield (300) between the converter and product, by moving turntable 70 as required into and away from the source, by adjusting the aperture, offset, and modifying the turntable distance from the source, or by adjusting the distance, 'L', between the collimator (110) and source (100).

The geometry of the radiation beam (40, 45) produced from a source, for example, but not limited, to a γ-radiation (40) emitted by a radioactive source (e.g. 100; for example but not limited to Co-60), or accelerating high energy electrons (10, 15) interacting with a suitable converter (30) to produce X-rays (45), is determined by the relationship between the following parameters:

a) the width of the radiation beam, either γ or X-ray (50; FIG. 3);
b) the distance (L) between the source (100) or converter (30) and the collimator (110);
c) the distance (S) between the collimator (110) and the product (60) center of rotation,
d) the size of the aperture (A) in the collimator (110), and
e) the position of an auxiliary shield (300).

These parameters determine divergence of the beam and the associated penumbra. Optimisation of these parameters relative to the size and density of a product reduces the DUR within the product.

Dynamically Adjusting 'A/r' and Associated Parameters During Processing

An initial adjustment of the ratio of beam width to the product width (A/r) for a product of a certain density is typically sufficient for a range of product densities and product configurations to obtain a sufficiently low DUR. However, in the case of irregular, or irregular rectangular product shapes, or product containing products with differing densities, modulation of the A/r ratio may be required to obtain a low dose uniformity within a product. Other parameters may also be adjusted to optimize dose uniformity within the product. These parameters may include adjustment of the speed of rotation of the product, modifying the beam power, thereby modulating the rate of energy deposition within the product, or both. Modulation of beam power may be accomplished by any manner known in the art including but not limited to adjusting the beam power of the accelerator, or if desired, when using a radioactive isotope as a source, attenuating the radiation beam by reversibly placing partially radiation opaque shielding between the source and product. Minor adjustments to the intensity of the radiation beam may also include modulating the distance between the product and source.

Design of the converter (30) also may be used to adjust the effective energy level of an X-ray beam. As the thickness of the converter increases, lower energy X-rays attenuate within the converter, and only X-rays with high energy exit the converter. Therefore by varying the thickness of the converter the energy level of all, or of a portion of, the X-ray beam may be modified. For example, in the case where the electrons emitting from the scanning horn are not parallel, it may be desired that the upper and lower regions of the X-ray beam be of higher average energy since the beam travels through a greater depth within the product, compared to the beam intercepting the mid-region of the product (however, it is to be understood that parallel electrons may be produced from a scanning horn using one or more magnets positioned at the end of the scanning horn to produce a parallel beam of electrons). Furthermore, these regions of the product experience less radiation backscatter due to the abrupt change in density at the top and bottom of the product. Therefore, a converter with a non-uniform thickness, wherein the thickness increases in its upper and lower portions, may be used to ensure higher energy X-rays are produced in the upper and lower regions from the converter. Modifications to converter thickness typically can not be performed in real time. However, different converters may be selected with different thickness profiles that correspond with different densities or sizes of products to be processed. Furthermore, the power of the beam may also be modulated as a function of vertical position within the product so that a higher power is provided at the upper and lower ends of the product.

Additionally, the scan speed of the electron beam can be varied as a function of position of the beam relative to the converter, product, or both the converter and product. If a constant rate of scan of the electron beam is maintained, then due to the scatter of the X-rays produced from the converter, higher levels of radiation are delivered within the central area of the product, and decreasing amounts of radiation are delivered at the ends of the product. An example of the variation is the dose delivery within the vertical dimension of a product can be seen as a solid line in FIG. 3(*e*). In this example, the bottom and top regions of the product receive about 50% of the radiation when compared to the central region of the product. This variation may be reduced in a variety of ways, examples of which include and are not limited to, modulating the speed of the beam in the "Z" (vertical) direction relative to the product (which may be stationary in the vertical direction), or moving the product vertically relative to the beam, which may be stationary, increasing the relative duration of irradiation at the upper and lower regions of the product, modifying the instantaneous vertical scan speed, using a smaller scan horn thereby reducing the scatter of the X-ray beam, or using a smaller aperture height, again reducing scatter of the X-ray beam. This latter alternative may be obtained by increasing the rate of vertical scan when the electron beam is delivering energy within the mid-vertical region of the product, and reducing the rate of scan towards each of the extremities of the vertical scan (at both the top and bottom of the product). In this manner, the amount of radiation received at the top and bottom regions of the product is increased, while the central dose is decreased somewhat (dashed line, FIG. 3(*e*)).

Other methods may be employed to increase the effective dose received at the ends (upper and lower) of the product. Since the upper and lower regions of the product experience less radiation backscatter, the density discontinuity at these regions may be reduced or eliminated by placing reusable end-caps of substantial density onto the turntable and top of the product as required, thereby increasing back-scatter at these regions.

Referring now to FIG. 4, which illustrates an embodiment of the present invention, a radiation source (100) provides an initial radiation beam (40) of an intensity and energy useful for radiation processing of a product. The radiation source may be a radioactive isotope, electron beam, or X-ray beam source. Preferably, the source is an X-ray source produced from an electron beam (see FIGS. 5 and 6). The radiation beam passes through the aperture (generally indicated as 170) of an adjustable collimator (110) to shape the initial radiation beam (40) produced by the radiation source (100) into a collimated radiation beam (50). The aperture of the collimator can be adjusted to produce a collimated radiation beam of optimal geometry for radiation processing a product (60) of known size and density. The distance between the product and the source, collimator, or both source and collimator (e.g. L and S; FIG. 3) may also be adjusted as required to optimize the A/r ratio, and hence the DUR, for a given product.

The product (60) rotates on turn table (70) in the path of the collimated radiation beam (50). The product rotates at least once during the time interval of exposure to the radiation source. Preferably, the product rotates more than once during the exposure interval to smooth any variation of dose within the product arising from powering up or down of the accelerator. Detectors (180), and turn-table (70) are connected to the control system (120) so that the size of the aperture (170) of the adjustable collimator (110), the power (intensity) of the initial radiation beam (40), the speed of rotation of turntable (70), the distance of the turntable from the source (L+S), collimator (S), or a combination thereof, may be determined and adjusted, as required, either before or during radiation exposure of the product (60).

The embodiment described may also be used to irradiate products (60) of known. dimensions and densities and achieve a relatively low DUR within the product. As one skilled in the art would appreciate, the radiation dose being delivered to the product may be varied as required to account for changes in the distance of the product to the source, width of the rotating product, and density of product. For example, but not to be considered limiting, control system (120) may comprise a timer which dynamically regulates the aperture (170) of adjustable collimator (110) to produce a collimated radiation beam of controlled width (A), to account for changes in the width (r) of rotating product (69). The beam power of radiation source (100) may also be modulated as a function of the rotation of turn-tables (70; as detected by angular position detector 230). In such a case, for example, but which is not to be considered limiting, a rectangular product of known dimension may be aligned on turn-table (70) in a particular orientation (detected by 230) such that as turn-table (70) rotates through positions which bring the corners of the product closer to radiation source (100) the radiation beam may be modified. Such modification may include dynamically adjusting the collimator (110) to modulate the dimension (e.g. A) of the collimated radiation beam (50), adjusting the width of the beam diameter, for example by adjusting the width of the scanning pattern, adjusting the distance between the product and source, or collimator, thereby modifying the relative beam dimension (A) and energy level with respect to the product, or placing or positioning an auxiliary shield (300) between the converter and product in order to adjust penumbra, and to shield and reduce the central dose of the radiation beam within the product. The control system may also regulate the energy and power of the initial radiation beam. Alternatively, control system (120) may regulate the rotation velocity of the turn-table as it rotates thereby allowing the corners of the product to be irradiated for a period of time that is different than that of the rest of the product. It is also contemplated that the control system may dynamically regulate any one, or all, of the parameters described above.

Referring now to FIG. 5, which illustrates another embodiment of the invention, wherein radiation source (100) is a source of X-rays produced from converter (30). Electrons (10) from an accelerator (20) interact with a converter (30) to generate X-rays (45). The X-ray beam (45) is shaped by aperture (170) of adjustable collimator (110) into a collimated X-ray beam (50) of optimal geometry for irradiation of the product (60) which rests on turn-table (70). Again, control system (120) monitors and, optionally, controls several components of the apparatus, including the rotation of turn-table (70), aperture of the collimator (110), power of the electron beam produced by accelerator (20), distance between turntable and the collimator (L), or a combination thereof.

During radiation processing, product (60) rotates about its vertical axis and intercepts a vertical collimated radiation beam (50). The product rotates at least once during the time exposed to radiation. In most, but not all instances, the width (A; FIG. 3) of the collimated beam is relatively narrow compared to the width of the product (r). Since the vertical plane of the collimated beam (50) is aimed at the centre of the rotating product (60), the periphery of the product is intermittently exposed to the radiation beam. This arrangement compensates for the relatively slow dose build-up at the centre of the product due to attenuation of X-rays by the materials of the product and produces a low DUR. With increased product density, for example but not limited to food such as meat, a narrower collimated beam width will be required in order to obtain a low DUR. Conversely, if a product is of a lower density (for example, medical supplies or waste) the beam width may be increased, or the radiation beam offset from the axis of rotation of the product, since the central portion of the product will receive its minimum dose more readily than that of a product of higher density.

In the embodiment shown in FIG. 5, the control system (120) is capable of modulating any or all of the irradiation parameters as outlined above. In certain cases however, such as irradiation of cylindrical products of uniform and relatively low densities, for example sterilization medical products, or it may be advantageous to irradiate the product with a radiation beam having a width approaching or approximately equal to the width of the product. The adjustable collimator of the proposed invention effectively allows this to be accomplished. By controlling the processing parameters this basic principle permits a relatively uniform radiation dose distribution and thus a low DUR to be delivered throughout the product for a large range of product size, shape and densities.

The converter (30) may comprise any substance which is capable of generating X-rays following collision with high energy electrons as would be known to one of skill in the art. The converter is comprised of, but not limited to, stainless steel, or high atomic number metals such as, but not limited to, tungsten, tantalum, gold or mercury. The interaction of high energy electrons with converter (30), produces X-rays and heat. Due to the large amount of heat generated in the converter material during bombardment by electrons, the converter needs to be cooled with any suitable cooling system capable of dissipating heat. For example, but not wishing to be limiting, the cooling system may comprise one or more channels providing for circulation of a suitable heat-dissipating liquid, for example water, however, other liquids or cooling systems may be employed as would be known within the art. The use of water or other coolants may attenuate X-rays, and therefore the cooling system needs to be taken into account when determining the energy level of the X-ray beam. As indicated above, attenuation of X-rays within the converter affects the energy spectrum of X-rays escaping from the converter. For example, which is not to be considered limiting, a tantalum converter of about 1 to about 5 mm thickness, with a cooling channel covering the downstream side of the converter, may be used to generate the bremsstrahlung energy spectrum for product irradiation as described herein. The cooling channel may comprise, but is not limited to two layers of aluminum, defining a channel for coolant flow.

FIG. 6 illustrates another embodiment of the present invention, where electrons (10) from an accelerator (20) interact with a converter (30) to generate X-rays (45). The X-rays (45) are shaped by aperture (170) of adjustable collimator (110) into an X-ray beam (50) of optimal geometry for irradiation of a product. Transmitted X-Rays (140) passing through product (60) are detected by one or more detector units (180). Detection system (130) is connected with detector units (180) and other detectors that obtain data from other components of the apparatus including turntable rotation velocity (70) and angular position (230), distance between turntable and collimator (S; 250, FIG. 7), accelerator power (20), collimator aperture width (170), conveyor position, via interface 200 and 210. The detection system (130) also interfaces with control system (120; FIG. 7) which also comprises a computer (120) capable of processing the incoming data obtained from the detectors, and sending out instructions to each of the identified components to modify their configuration as required.

Detector units (180) may comprise one or more radiation detectors for example, but not limited to, ion chambers placed on the opposite side of the product (60) with respect to the incident radiation beam (50). As the product turns through the radiation beam (50) the detector units (180) register the transmitted radiation dose rate. The difference between incident and exiting radiation dose, and its variation along the stack height is related to the energy absorbing characteristics of the product as a function of several parameters for example, energy of the radiation beam, distance between the turntable (product) and the collimator (S), as a function of the product's angular position. The difference can thus be directly related to the density and geometry of the product. This information may also be used for obtaining a diagnostic scan (see below) of the product. An example of detector arrays that may be used in the system just described is disclosed in WO 01/14911 (which is incorporated herein by reference).

A schematic representation of the control system (120) as described above is show in FIG. 7. The control system (120) comprises a computer capable of receiving input data, for example the required minimum radiation dose for a product (190), and data from components of the detection system (180) comprising the accelerator (240), turntable speed of rotation (70), angular position (230), distance to collimator (220), collimator aperture (170), wedge in and out location (310), beam axis offset (280), beam diameter and amplitude (260), and conveyors (150). The control system also establishes settings for, and sends the appropriate instruction to, each of these parameters to optimize properties of the radiation beam relative to the product and produce a low DUR. Those of skill in the art will understand that variations of the control system may be possible without departing from the spirit of the current invention.

The embodiment outlined in FIG. 6 permits real-time monitoring of radiation processing of a product, and for real time adjustment between radiation processing of products that differ in size, density or both size and density, so that an optimal radiation dose is delivered to each product to produce a low DUR. Adjustments to the parameters of the apparatus described herein may be made based on information obtained from a diagnostic scan. An optimized radiation exposure may be determined by calculating the difference between the transmitted radiation detected by detector units (180) and the incident radiation at the surface of the product closest to the radiation source (this value can be calculated or determined via appropriately placed detectors), as a function of the rotation of the product. In this way, the radiation dose of any product may be "fine-tuned" to deliver a requisite radiation dose to achieve a low DUR within a product.

The inclusion of a radiation detection system (130) also permits obtaining a diagnostic scan of the product (60) to determine the irradiation parameters required to deliver a relatively even radiation dose distribution (low DUR) in a product. The diagnostic scan characterises the product (60) in terms of its geometry and apparent density before any significant radiation dose is accumulated in the product. As suggested in previous embodiments described herein, the diagnostic scan is not required for products of uniform density and stack geometry. The diagnostic scan may be carried out during the first turn of the product (60), or the diagnostic scan may be performed during multiple rotations of the product. The diagnostic scan may comprise irradiating the product with a low power beam so that a low dose is received within the product, for example, but not limited to from about 1 to about 50% of the maximum radiation dose to be received by the product. However, it is to be understood that higher doses may also be used for the diagnostic scan if required. The difference in the amount of radiation sent to the product, and that transmitted through the product (as detected by detectors 130) gives an indication of the density and uniformity of the product. The information determined as a result of the diagnostic scan may be used to set the operational parameters as described herein for product irradiation.

Those skilled in the art would understand that in order to irradiate a product to obtain a low DUR, the radiation beam must be capable of penetrating at least to the midpoint of a product. Similarly, if the detection system of the current invention is employed to automatically set the parameters for radiation processing of the product, then the radiation must be capable of penetrating the product.

The control system (120) of the present embodiment is designed to simultaneously adjust any one or all the processing parameters of the apparatus as described herein, for example but not wishing to be limiting, the total radiation exposure time, the ratio of the radiation beam width to the principal horizontal dimension of the product, in relation to the angular position (ϕ) of the X-ray beam (ratio of A(ϕ)/r (ϕ)), the power of the radiation beam, the rotational velocity of the turn-table, and the distance between the product and collimator. The control system may adjust the processing parameters based on the total radiation dose required within the product as input by an operator, or the radiation dose may be automatically set at a predetermined value. For example, but not wishing to be limiting, if it is known that a certain base radiation dose is required for a given product, for example the treatment of a food product, then this dose may be preset, and the operating conditions monitored to achieve a low DUR for this dose. However, if two products are of different dimensions or different densities then dissimilar irradiation parameters may be required to deliver the predetermined total radiation dose with an optimal DUR to each stack.

Figure 8A:
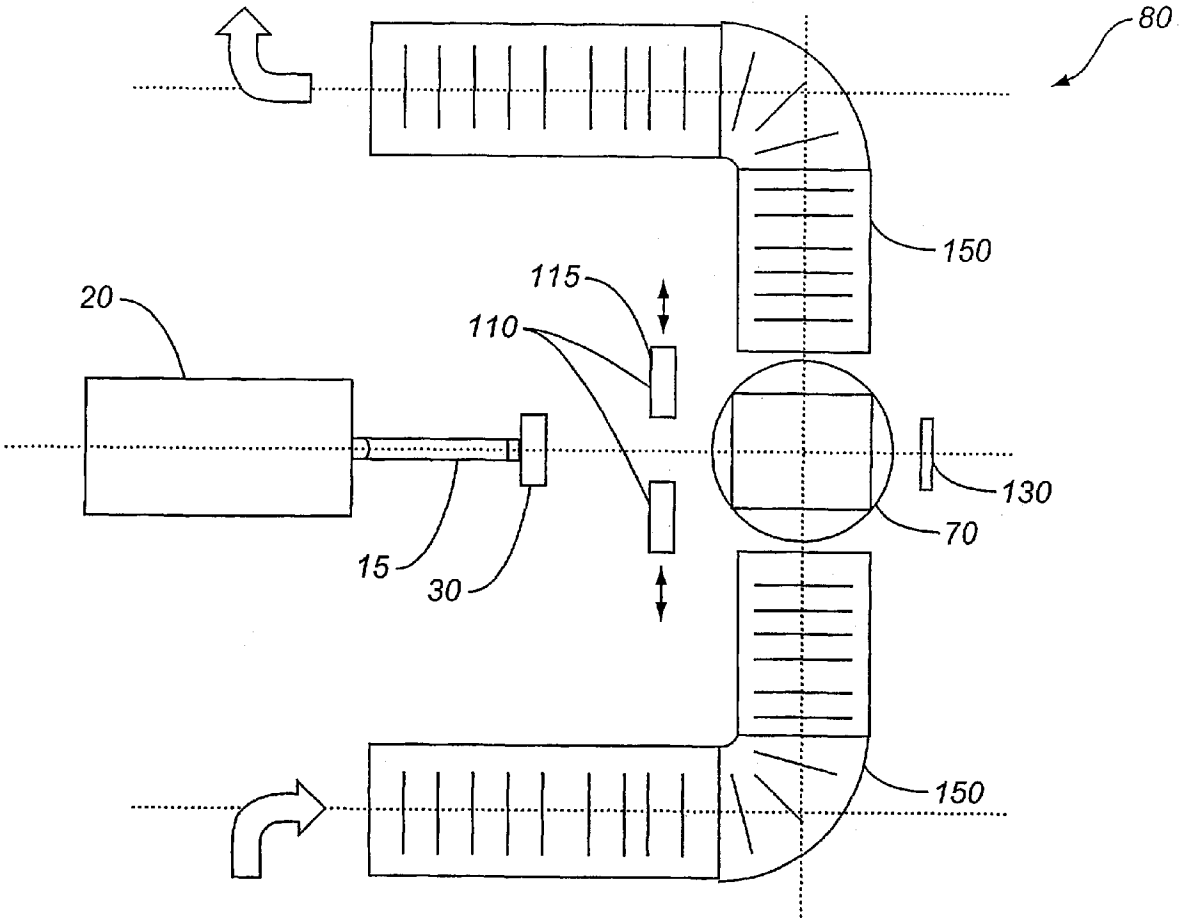
FIG. 8 illustrates several aspects of the current invention.
Figure 8B:
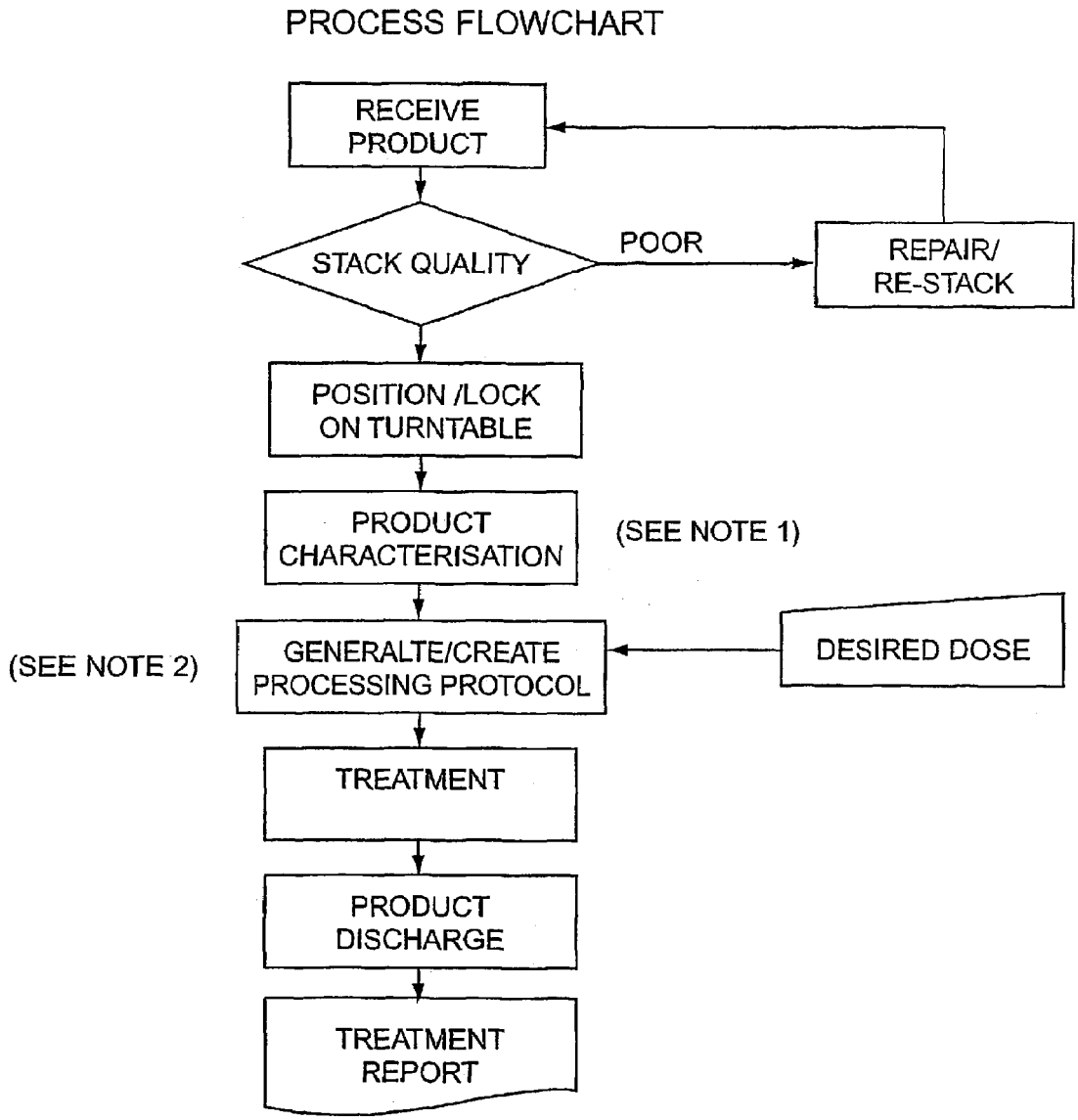
Figure 8C:
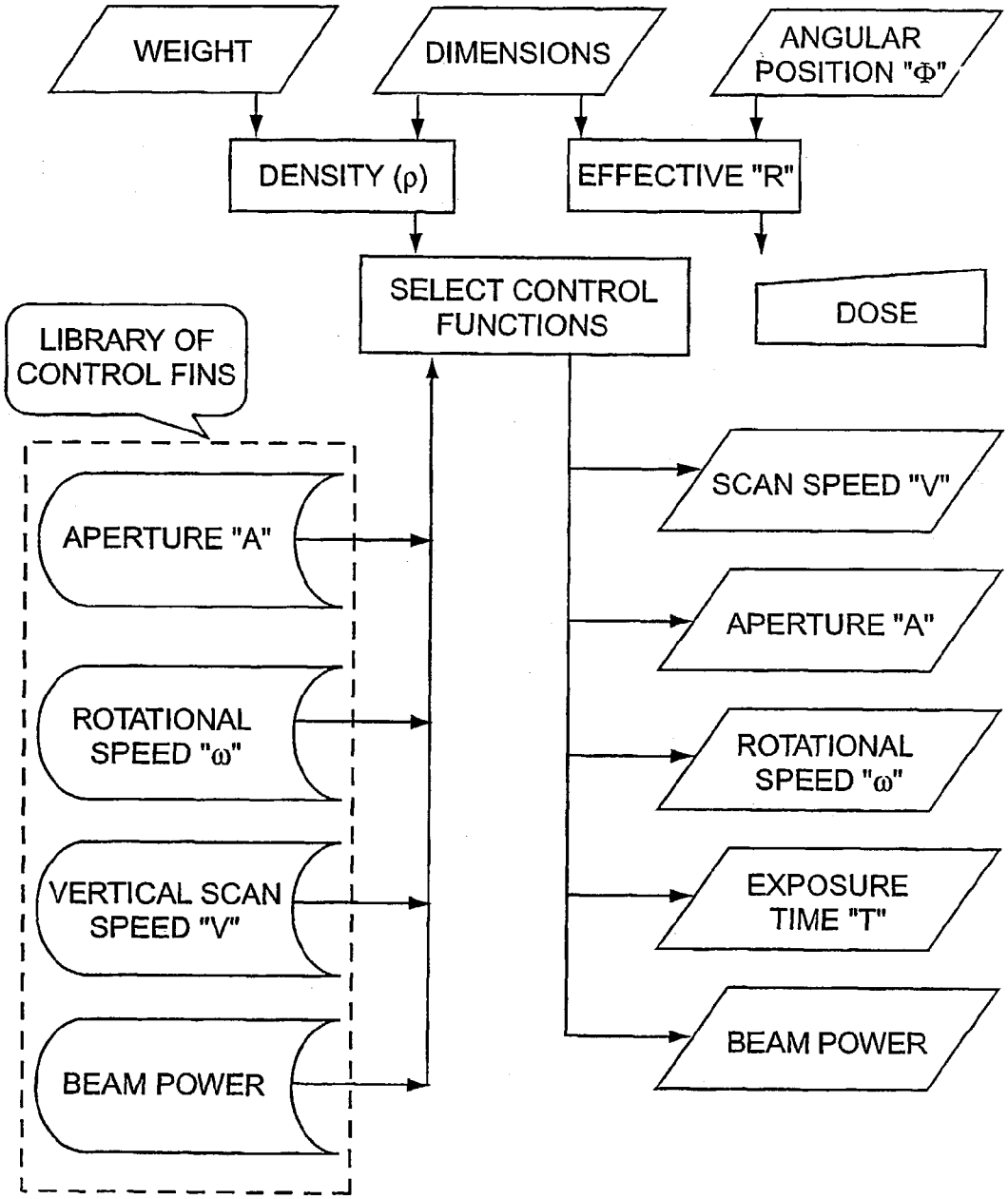

As shown in FIG. 8(*a*), the apparatus of the present invention may be placed within a conveyor system to provide for the loading and unloading of products (60) onto turntable 70. A conveyor (150) delivers and takes away products, for example but not limited to, palletized products or totes, to and from the turntable (70). In the embodiment shown, the collimated radiation beam is produced from a converter (30) that is being bombarded with electrons produced by accelerator 20, and travelling through a scanning horn (25). However, it is to be understood that the source may also be a radioactive isotope as previously described. Not show in FIG. 8(*a*) are components of the detection or control systems.

An outline of a series of process involved in irradiating a product using the methods as described herein is provided, but not limited to, the sequence in FIG. 8(*b*). Typically, a product (60; FIG. 8(*a*)) is received and the quality of the product, or product stack determined by any suitable means, for example, by visual inspection. If the product stack is of poor quality the stack is repaired or re-stacked. The product is transported to, and positioned on the turntable, where the product is characterized using one or more characteristics of the product, for example, but not limited to product weight, product dimension, a diagnostic scan wherein the product is characterized in terms of one or more properties, for example, but not limited to, its geometry and apparent density so that the mass distribution through the product may be determined, or a combination thereof. From this product characterization, and the desired dose to be delivered to the product, and the processing protocol (see FIG. 8(*c*)) is determined to minimize the DUR. The parameters considered in selecting control functions (to create the processing protocol) that determine the dose to be given to a product are shown in FIG. 8(*c*). The processing protocol is dependent upon product characteristics, and the aperture of the collimator, speed of rotation of the turntable (instantaneous rotational velocity), power of the radiation beam, duration of treatment time, or other variables as described herein (see FIGS. 7 and 8(*c*)). These parameters may be stored in any suitable manner, for example, within the memory of the control system or on a disc or other suitable medium as desired. Once these parameters are established and the components of the product irradiator set, the product is treated with radiation for a period of time. Preferably, the treatment takes place in the same location as the diagnostic scan, however, the diagnostic scan and creation of the processing protocol (selection of control functions, and storage of appropriate instructions) outlined in FIG. 8(*c*) may take place at a first location, and the product moved to a second location for irradiation using the processing protocol created as outlined in FIG. 8(*c*).

Therefore, the present invention also provides a medium storing instructions adapted to be executed by a processor to modulate parameters involved during product irradiation. These parameters may include, but are not limited to, one or more of: the width of a collimator, modulation of the intensity of a radiation beam, modulation of the scan speed, modulation of the rate of product rotation, and the exposure time.

The duration of treatment may be predetermined and derived from the step of product characterization, for example using a diagnostic scan, or the radiation may be monitored in real-time during treatment using detector units (180, FIG. 6). When the desired radiation dose is obtained, and the product treated, the product is then transported from the turntable to an unload-area. A report recording the processing parameters of the treatment may be generated by the control system (120) as required.

Products to be processed using the apparatus and method of the present invention may comprise foodstuffs, medical articles, medical waste or any other product in which radiation treatment may promote a beneficial result. The product may comprise materials in any density range that can be penetrated by a radiation beam. Preferably products have a density from about 0.1 to about 1.0 g/cm$^3$. More preferably, the range is from about 0.2 to about 0.8 g/cm$^3$. Also, the product may comprise but is not necessarily limited to a standard transportation pallet, normally having dimensions 42×48×60 inches. However any other sized or shaped product, or product may also be used.

The present invention may use any suitable radiation source, preferably a source that produces X-rays. The electron beam may be produced using an RF (radio frequency) accelerator, for example a "Rhodotron" (Ion Beam Applications (IBA) of Belgium), "Impela" (Atomic Energy Of Canada), or a DC accelerator, for example, "Dynamitron" (Radiation Dynamics), also the radiation source may produce X-rays, for example which is not to be considered limiting, through the ignition of an electron cyclotron resonance plasma inside a dielectric spherical vacuum chamber filled with a heavy weight, non-reactive gas or gas mixture at low pressure, in which conventional microwave energy is used to ignite the plasma and create a hot electron ring, the electrons of which bombard the heavy gas and dielectric material to create X-ray emission (U.S. Pat. No. 5,461,656). Alternatively, the radiation source may comprise a gas heated by microwave energy to form a plasma, followed by creating of an annular hot-electron plasma confined in a magnetic mirror which consists of two circular electromagnet coils centered on a single axis as is disclosed in U.S. Pat. No. 5,838,760. Continuous emission of bremsstrahlung (X-rays) results from collisions between the highly energetic electrons in the annulus and the background plasma ions and fill gas atoms.

It is also contemplated in the present invention that the radiation source may comprise a gamma source. Since gamma sources comprising radionucleotides such as cobalt-60 emit high energy radiation in multiple directions, one or more of the systems described herein may be positioned around the gamma source, permitting the simultaneous radiation processing of a plurality of products. Each system would comprise an adjustable collimator (110), turntable (70), detection system (130), a means for loading and unloading the turntable (e.g. 150), and be individually monitored so that each product receives an optimal radiation dose with a low DUR. In this latter embodiment, one control system (120) may monitor and control the individual components of each system, or the control systems may be used individually.

The above description is not intended to limit the claimed invention in any manner, furthermore, the discussed combination of features might not be absolutely necessary for the inventive solution.

The present invention will be further illustrated in the following examples. However it is to be understood that these examples are for illustrative purposes only, and should not be used to limit the scope of the present invention in any manner.

EXAMPLES

Example 1

Radiation Profiles in a Product with Densities of about 0.2 or about 0.8 g/cm$^3$ An accelerator capable of producing an electron beam of 200 kW and 5 MeV is used to, generate X-rays from a tungsten, water cooled converter. The bremsstrahlung energy spectrum of the X-ray beam produced in this manner extends from 0 to about 5 MeV, with a mean energy of about 0.715 MeV. A cylindrical product of 120 cm diameter, comprising a product with an average density of either 0.2 or 0.8 g/cm$^3$ is placed onto a turntable that rotates at least once during the duration of exposure to the radiation beam. The distance from the source plane (converter) to the center of the product is 112 cm. The collimator is set to produce a beam width of 10, 50 or 120 cm. The rectangular cross section of height of the beam is set to the height of the product. Typically to deliver a dose of about 1.5 kGy to a product characterised in having a density of 0.2 g/cm$^3$, the product is exposed to radiation for about 2 to about 2.5 min, while a product having an average density of 0.8 g./cm$^3$ is exposed for about 10 min in order to achieve the desired $D_{min}$.

Figure 9:
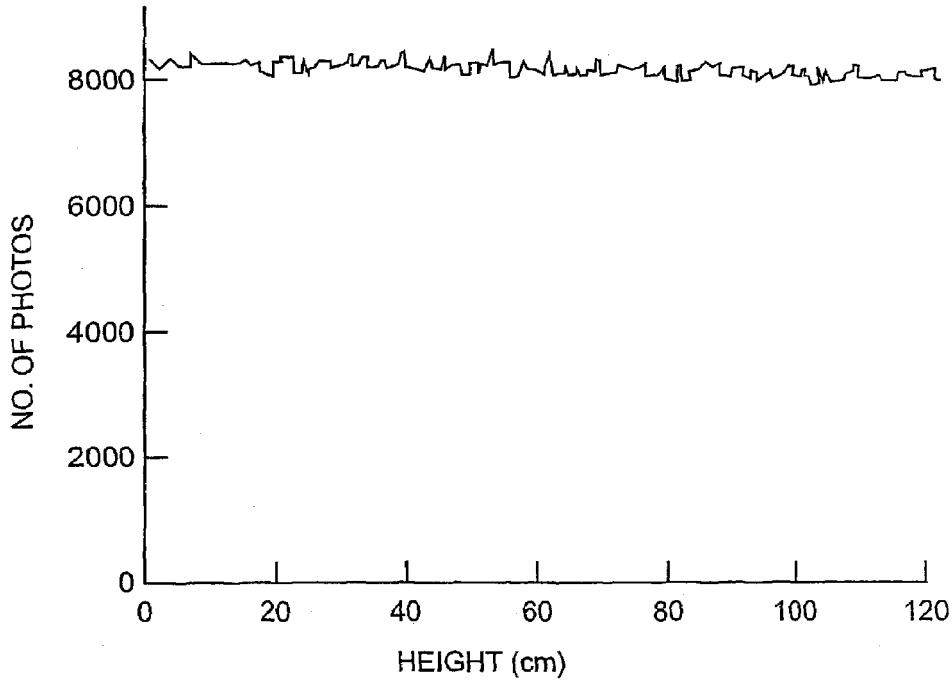
FIG. 9 shows uniformity of bremsstrahlung energy (as indicated by the number of photons) over the height of a product stack.

The photon output over the height of the beam was determined for each aperture width, and is constant in both a horizontal and vertical dimension (FIG. 9). Depth dose profiles are determined for three aperture widths, 10, 50 and 120 cm, for a 5 Mev endpoint bremstrahlung x-ray spectrum, with a mean energy of about 0.715 MeV, for each product average density. The results are presented in FIGS. 10(*a*) and (*b*)), and Tables 1 and 2.

TABLE 1

Figure 10A:
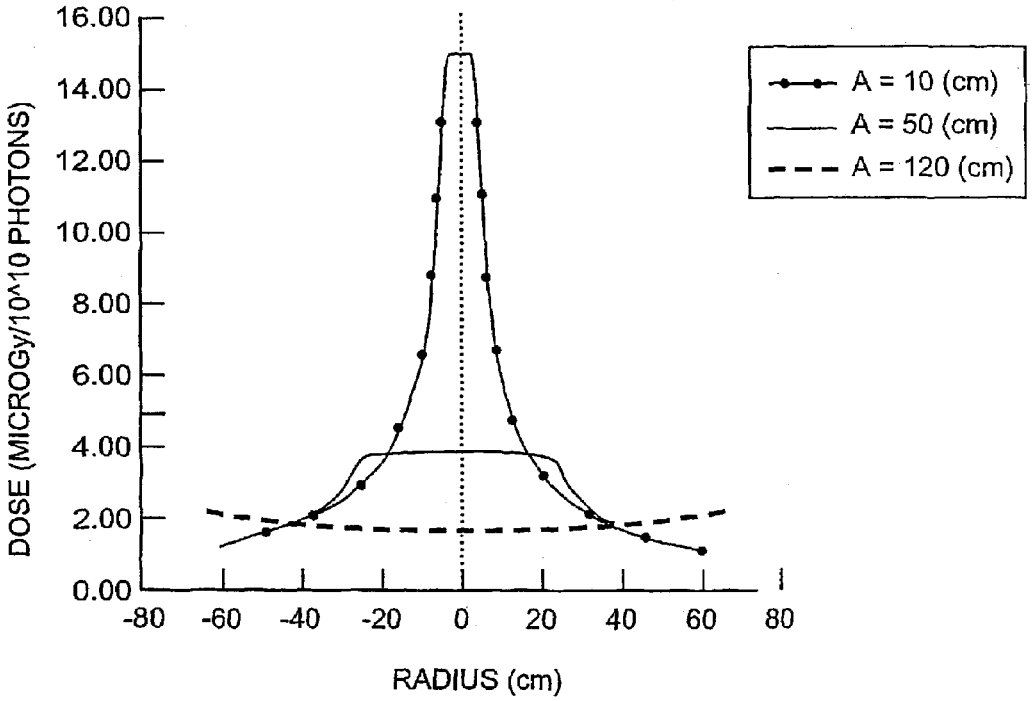
FIG. 10 shows the dose depth profile for products rotating on a turntable and exposed to X-ray radiation.

Results for a 0.2 g/cm$^3$ product (see FIG. 10(a))

| Aperture (cm) | $Dose_{Max}$:$Dose_{Min}$ | Beam use efficiency (%) |
|---|---|---|
| 10 | 12.6 | 49.5 |
| 50 | 3.1 | 48.5 |
| 120 | 1.14 | 41.7 |

TABLE 2

Figure 10B:
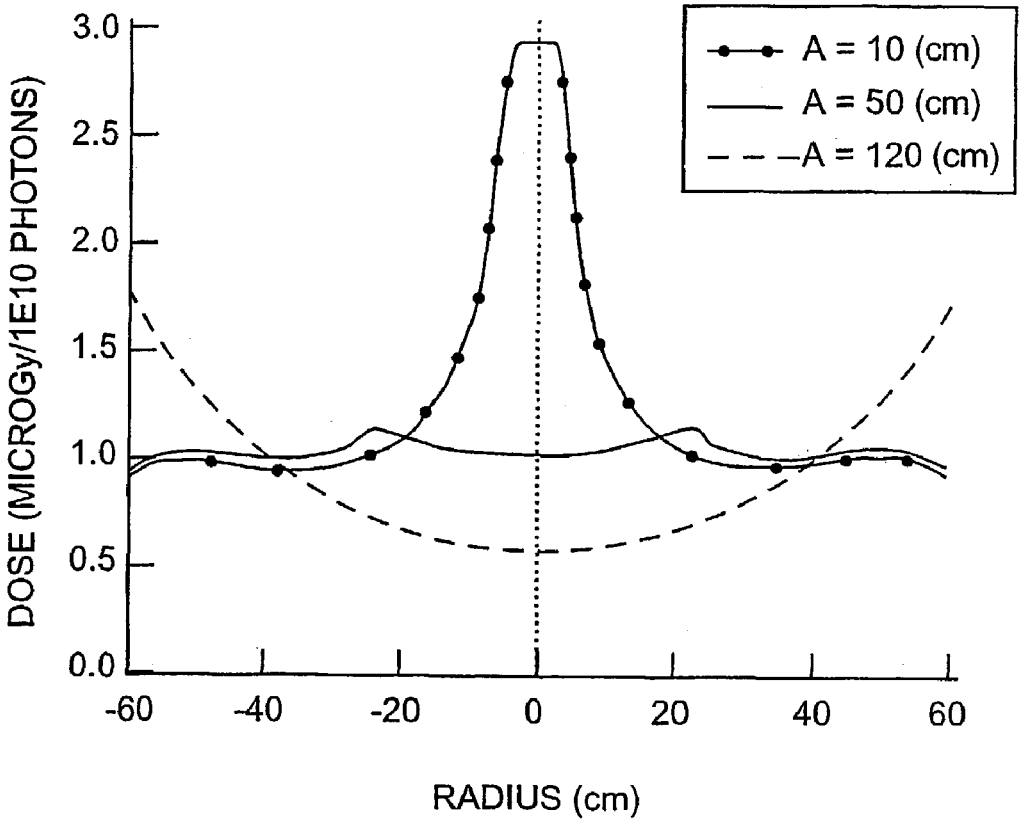

Results for a 0.8 g/cm$^3$ product (see FIG. 10(b))

| Aperture (cm) | $Dose_{Max}$:$Dose_{Min}$ | Beam use efficiency (%) |
|---|---|---|
| 10 | 3.1 | 88.3 |
| 50 | 1.16 | 87.8 |
| 120 | 3.1 | 81.4 |

Example 2

Irradiation of Circular and Rectangular Products: 1 mm Convertor

Bremsstrahlung X-rays are produced as described above using a 5 MeV electron beam with a circular cross section (10 mm diameter) that scanned vertically across the converter. A 1 mm Ta converter backed with an aluminum (0.5 cm) water (1 cm) aluminum (0.5 cm) cooling channel is used to generate the X-rays. A product of 0.8 g./cm$^3$, with two footprints are tested: one involved a cylindrical product with a 60 cm or 80 cm radius footprint, the other is a rectangular product with a footprint of 100×120 cm, and 180 cm height, both product geometries are rotated at least once during the exposure time. The distance from the converter to the collimator is 32 cm.

In order to optimize DUR, several collimator apertures are tested for a cylindrical product (Table 3). Examples of several determinations of the dose along a slice of the product, for a 60 cm radius cylindrical product are presented in FIG. 11.

TABLE 3

DUR determination for cylindrical products (0.8 g/cm$^3$ density), of varying diameter (r), for a range of collimator aperture widths (A) using a 1 cm electron beam producing bremsstrahlung X-rays from a 1 mm Ta converter..

| Aperture, 'A' (cm) | $D_{max}$:$D_{min}$ r = 60 | r = 70 | r-80 |
|---|---|---|---|
| 8 | 1.63 | 1.61 | 1.72 |
| 10 | 1.41 | 1.38 | 1.72 |
| 11 | 1.13 | nd* | 1.76 |
| 13 | 1.19 | nd | nd |
| 15 | 1.14 | 1.38 | nd |
| 20 | 1.38 | 1.63 | 2.02 |

*nd not determined

Figure 11A:
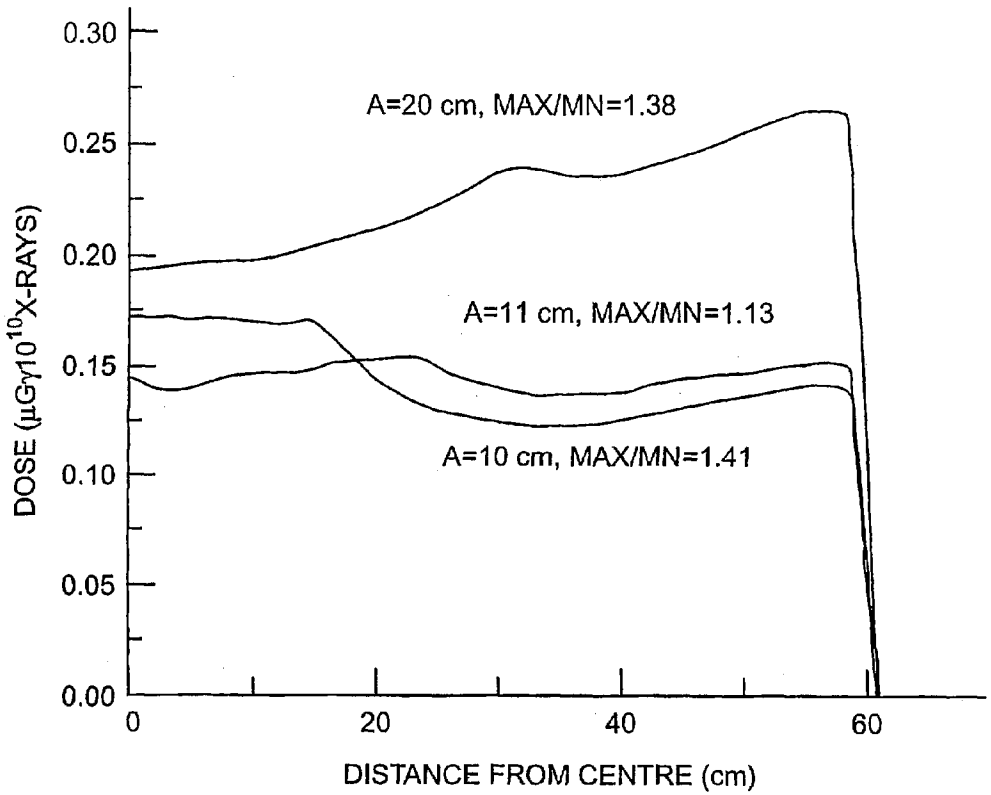
FIG. 11 shows the dose depth profile for cylindrical products rotating on a turntable and exposed to X-ray radiation for a product with a density of 0.8 g./cm$^3$, for three collimator aperture widths of, 10, 11 and 20 cm.
Figure 11B:
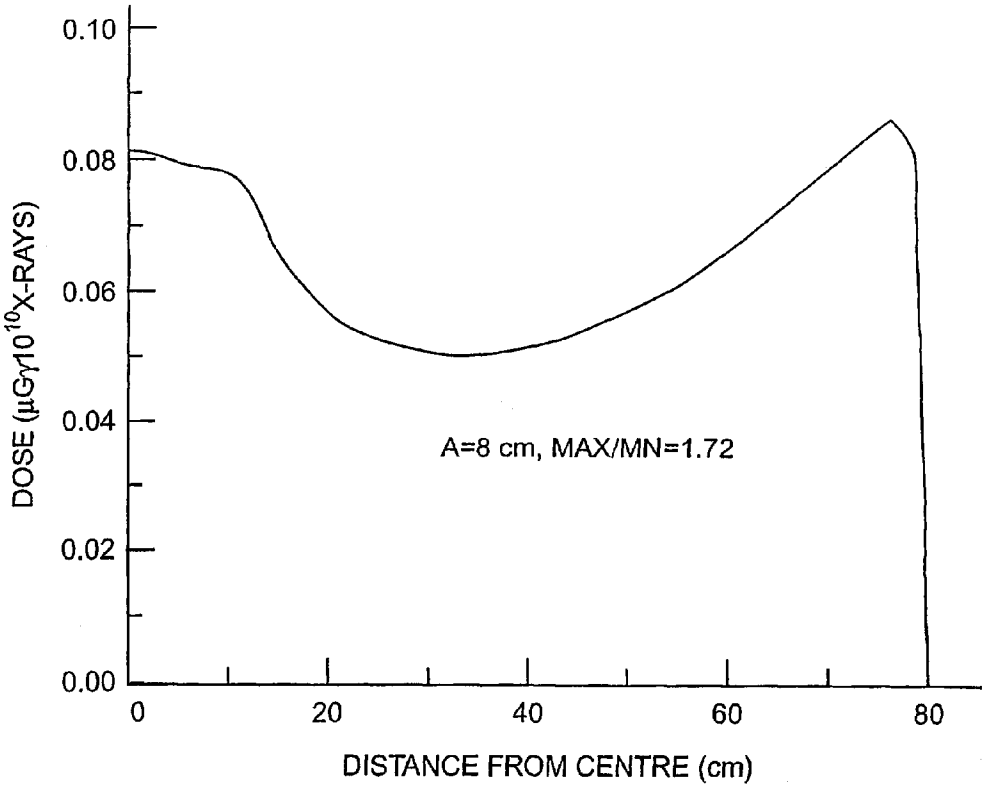
Figure 11C:
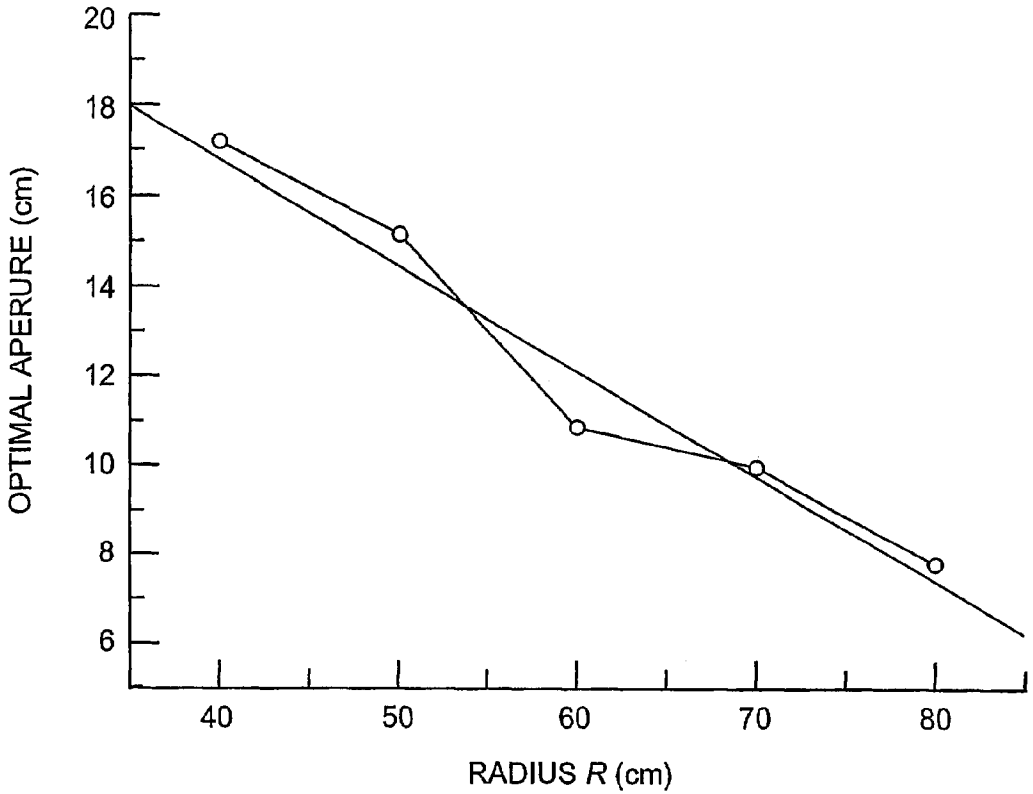
Figure 12A:
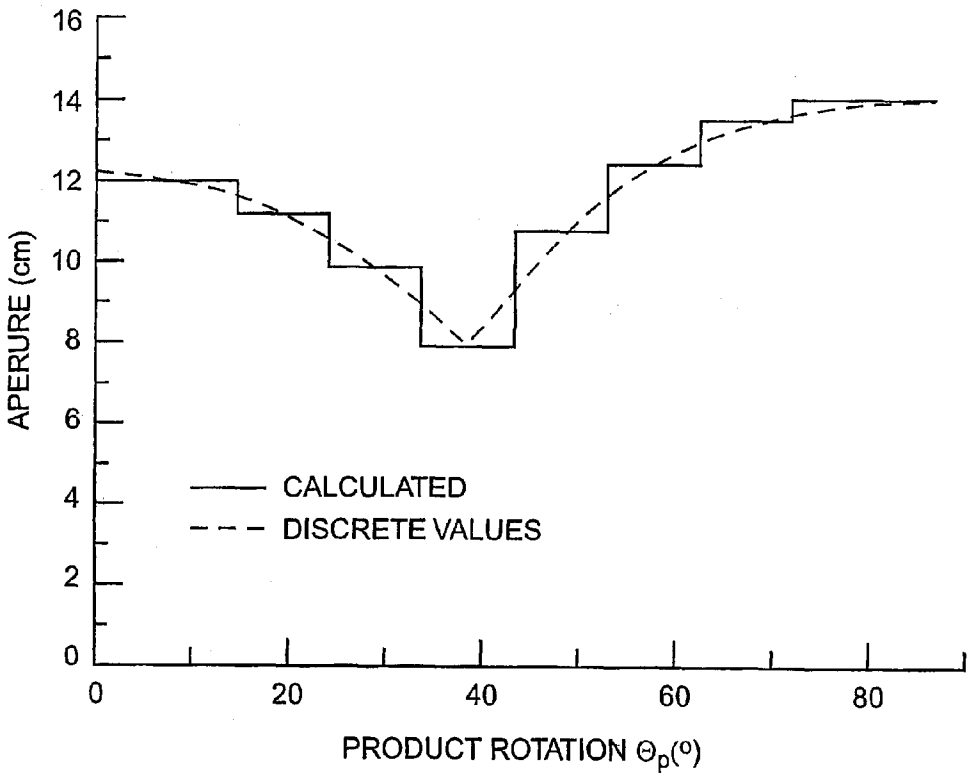
FIG. 12 shows one set of adjustments that may be made to collimator aperture width and radiation beam power during irradiation of a rotating rectangular product.
Figure 12B:
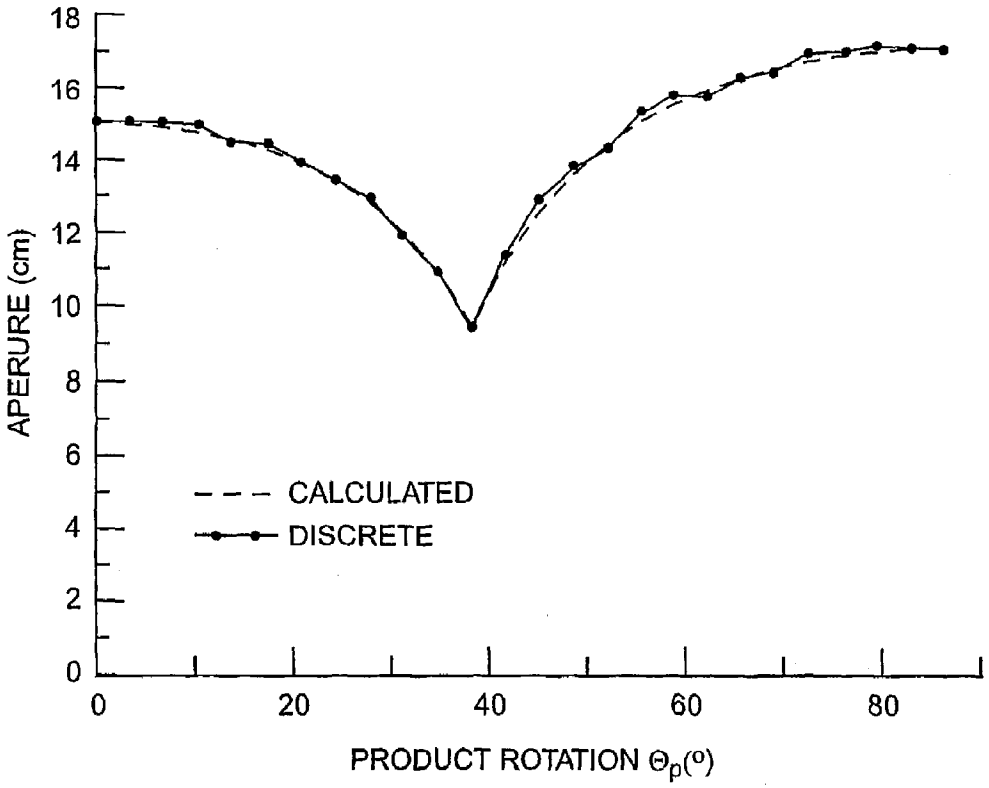
Figure 12C:
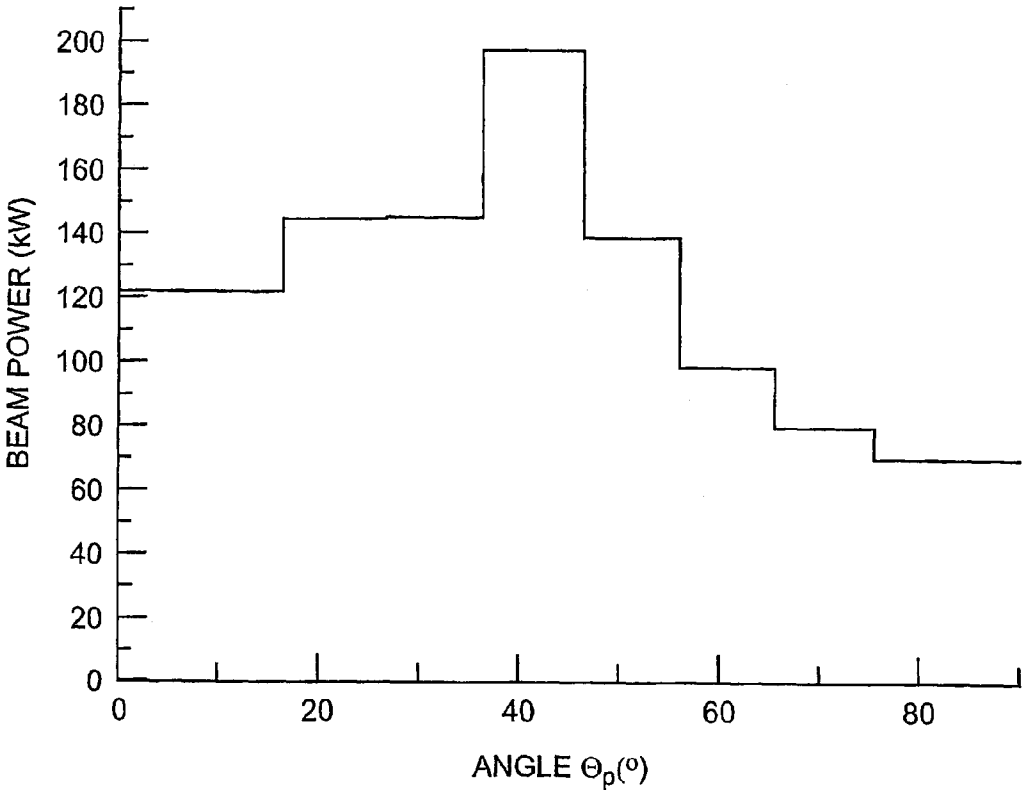
Figure 12D:
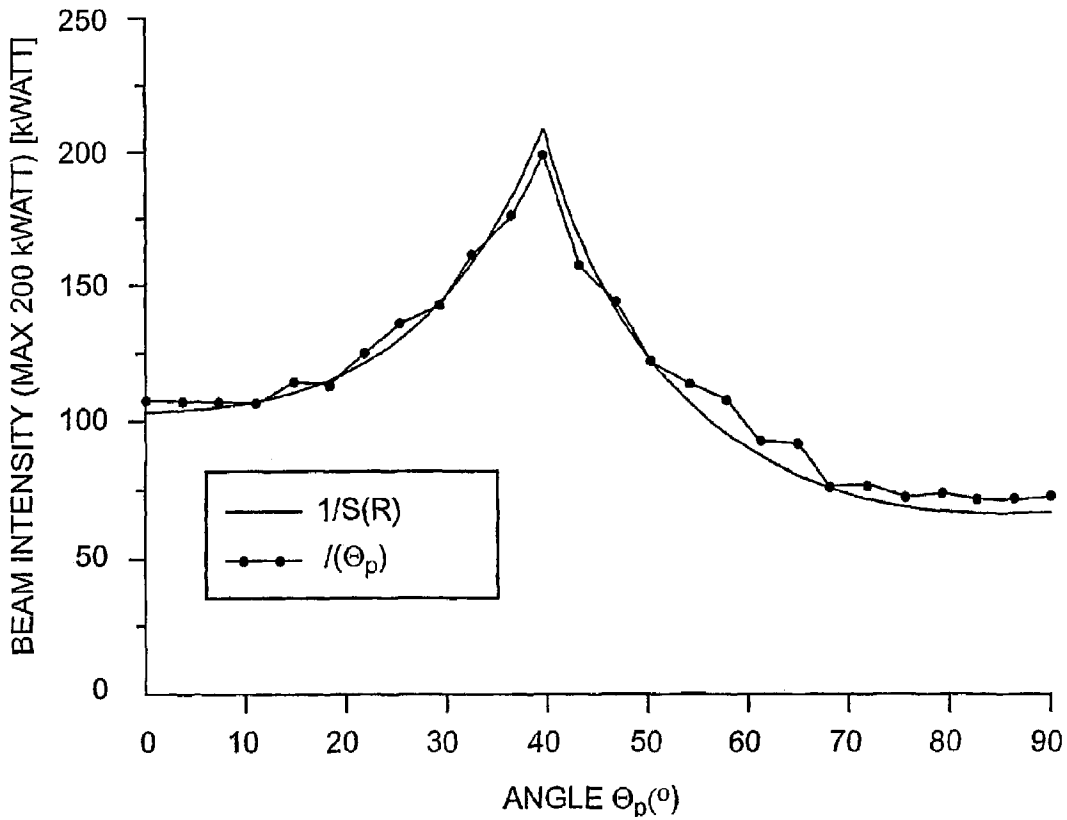

In each tested product diameter, the DUR varied as the collimator aperture changed. Typically, for smaller and larger apertures the DUR is higher when compared with the optimal aperture width. For example, a product of 60 cm diameter exhibites an optimal DUR with a collimator aperture of 11 cm. With this aperture width, the dose is generally uniform throughout the product (see FIG. 11(*a*)). With an increased width of collimator aperture, of 20 cm, the dose increases towards the periphery of the product, while with a smaller collimator aperture (10 cm), the central portion of the product receives an increase dose (FIG. 11(*a*)). With a product of increased diameter (80 cm), the DUR increased, and exhibites a greater variation in dose received across the depth of the product (FIG. 11(*b*)). The general relationship between width of collimator aperture and product diameter, that produces an optimal DUR is shown in FIG. 11(*c*), where, for a cylindrical product, the lowest DUR is achieved using a narrower aperture with increasing product diameter.

For a rectangular product footprint (120 cm×100 cm), the apparent depth of the product, relative to the incident radiation beam, varies as the rectangular product rotates, relative to the beam. In order to optimize the DUR, the collimator aperture width, beam intensity (power), or both, may be dynamically adjusted in order to obtain the most optimal DUR. An example of adjusting aperture width during product rotation is shown in FIG. 12(*a*). In this example, 8 aperture width adjustments are made over 90° rotation of the product. These same aperture adjustments are mirrored and repeated for the remaining 270° of product rotation so that 32 discrete aperture widths take place during one rotation of a rectangular product. An example of more alterations in aperture width, in this case 26 discrete width in 90° rotation, is shown in FIG. 12(*b*). However, it is to be understood that the number of discrete aperture widths may vary from the number shown in FIGS. 12(*a*) and (*b*), and may include fewer, or more, adjustments as required. For example, for products of lower density, fewer or no adjustments may be required.

An optimized DUR may also be obtained through adjustment of the intensity of the radiation beam during rotation of a rectangular product (FIG. 12(*c*)). In this example, 8 different beam power adjustments are made over 90° rotation of the product. The same beam power adjustments are mirrored and repeated for the remaining 270° rotation of the product. Again, the number of adjustments of beam power, as a function of product rotation, may vary from that shown in order to optimize DUR, depending upon the size and configuration of the product, as well as density of the product itself.

In order to further optimize the DUR, both the aperture and beam power may be modulated as the product rotates. When both parameters are modulated, a DUR of from 1.47 to 1.54 was obtained for irradiation of a 0.8 g./cm$^3$, rectangular product (footprint: 120 cm×100 cm), placed at 80 cm from the collimator aperture, using a 1 mm Ta converter (accelerator running at 200 kW, 40 mA electron beam at 5 MeV).

Example 3

Irradiation of Circular and Rectangular Products: 2.35 mm Convertor

The $D_{max}$:$D_{min}$ ratio may still be further optimized by increasing the overall penetration of the beam within the product. This may be achieved by increasing the thickness of the convertor to produce a X-ray beam with increased average photon energy. In order to balance yield of X-rays and beam energy, a Ta convertor of 2.35 mm (including a cooling channel; 0.5 cm A1, 1 cm $H_2O$, 0.5 cm A1) was selected. This thicker convertor generates fewer photons per beam electron (0.329 phton/beam electron), compared with the 1 mm convertor (0.495 photon/beam electron) due to the increased thickness and attenuation of the X-ray beam. However, even though the number of X-rays produced is lower with a 2.35 mm convertor, the beam that exits the convertor is of a higher average photon energy. As a result of the change in irradiation beam properties, the effect of aperture width and beam power were examined within cylindrical and rectangular products as outlined in Example 2. Results for adjusting the collimator aperture width are presented in Table 4.

TABLE 4

DUR determination for cylindrical products (0.8 g/cm$^3$ density), of varying diameter (r), for a range of collimator aperture widths (A) using a 1 cm electron beam producing bremsstrahlung X-rays from a 2.35 mm Ta converter.

| Aperture, 'A' (cm) | $D_{max}$:$D_{min}$ r = 60 | r = 70 | r-80 |
|---|---|---|---|
| 8 | nd* | 1.69 | 1.64 |
| 10 | 1.44 | 1.43 | 1.6 |
| 12 | 1.28 | 1.3 | 1.64 |
| 13 | | 1.32 | nd |
| 14 | 1.18 | 1.32 | nd |

TABLE 4-continued

DUR determination for cylindrical products (0.8 g/cm$^3$ density), of varying diameter (r), for a range of collimator aperture widths (A) using a 1 cm electron beam producing bremsstrahlung X-rays from a 2.35 mm Ta converter.

| Aperture, 'A' (cm) | $D_{max}$:$D_{min}$ r = 60 | r = 70 | r-80 |
|---|---|---|---|
| 15 | 1.14 | nd | nd |
| 20 | 1.28 | nd | nd |

*nd not determined

For the irradiation of a rectangular product (120 cm×100 cm; 0.8 g./cm$_3$ density), the collimator aperture may be adjusted to account for changes in the apparent depth of the product relative to the incident radiation beam during product rotation (FIG. 12(*b*)).

As outlined in example 2, the power of the beam may also be adjusted during product rotation (FIG. 12(*d*)).

By adjusting both collimator aperture width and beam power during product rotation, a DUR of from 1.27 to 1.32 is achieved.

Example 4

Irradiation of Circular Product: Effect of Auxiliary Shield

Figure 13A:
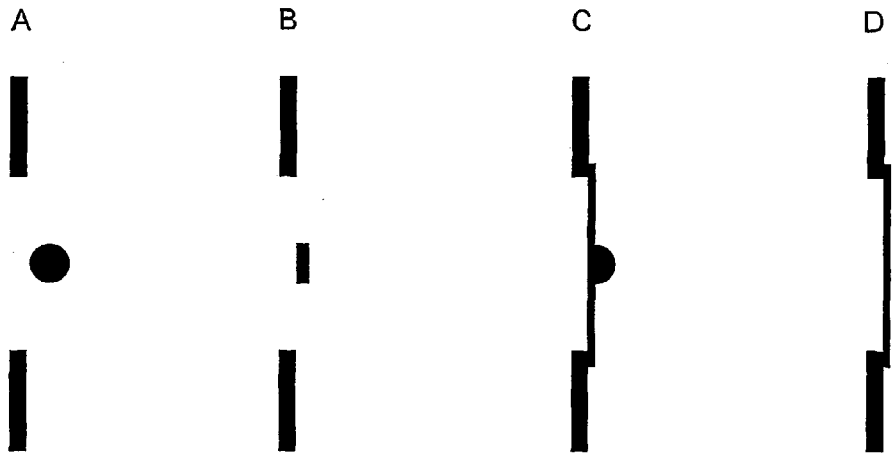
FIG. 13(A) shows several, types of auxiliary shields that may be used to modify the radiation beam as described herein.
Figure 13B:
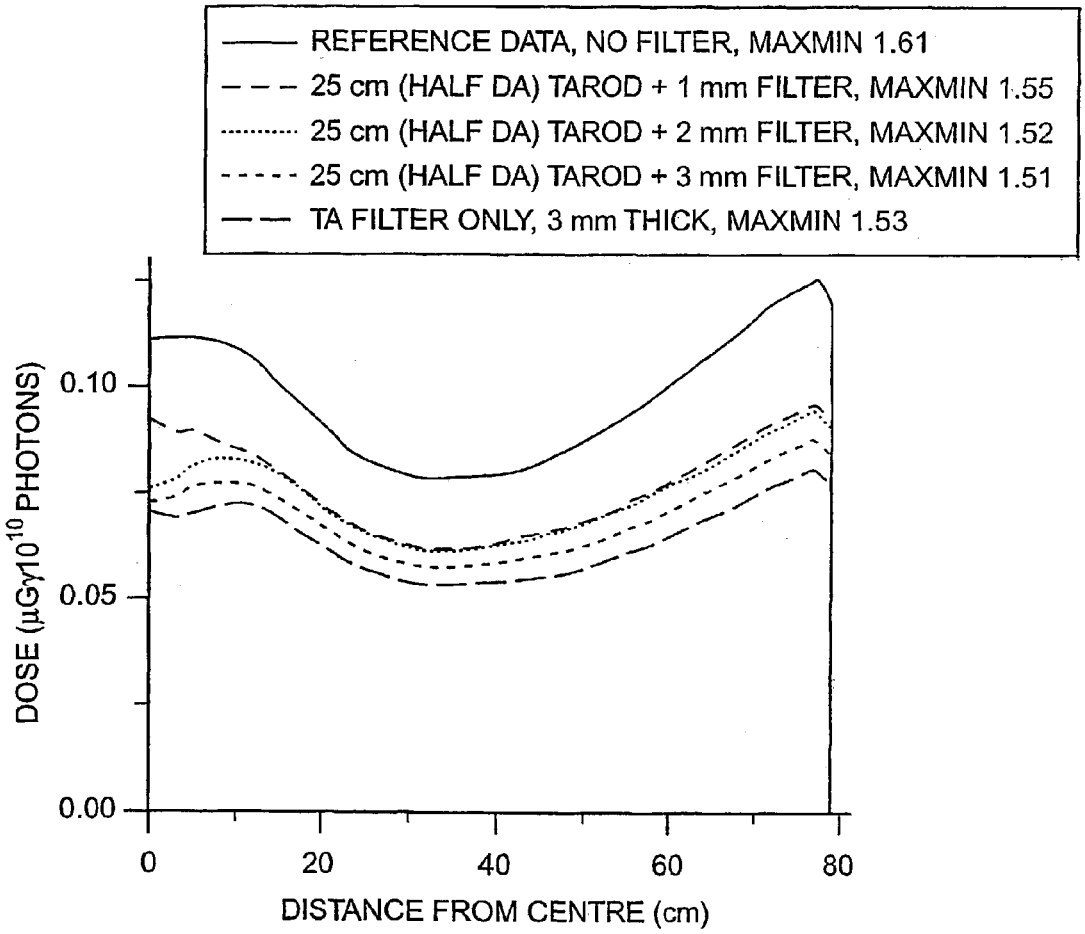
FIG. 13 shows several auxiliary shields of the present invention, and the effect of several shields on dose delivery within a product.

The $D_{max}$:$D_{min}$ ratio may also be optimized by profiling the beam using an auxiliary shield. Various shapes and types of auxiliary shields were tested (examples of several are shown in FIG. 13(*a*)).

For these analysis, a Ta convertor of 2.35 mm (including a cooling channel; 0.5 cm Al, 1 cm $H_2O$, 0.5 cm Al) is used, with an ebeam energy of 5 Mev (beam current 40 mA; beam power 200 kW max, 78 kW min; 117 kW avg.), an aperture of 9.5 cm., and a distance from the converter to collimator of 32 cm. A circular product (80 cm radius), with a density of 0.8 g/cm3 is tested. Under these conditions, a DUR (Max/Min) value of 1.61 is observed.

Results from the insertion of several auxiliary shields (shown in FIG. 13), of varying compositions (Al or Ta) and sizes, within the aperture of the collimator are presented in Table 5. An example of the effect of an auxiliary shield on the dose distribution profiles of a product are shown in FIG. 13(*b*). The effect of the auxiliary shields on DUR were determined by comparing the $D_{min}$ and $D_{max}$ values across the entire product diameter (Max/Min 0 to 80 cm), and across the radius (Max/Min 0 to 40).

TABLE 5

Effect of auxiliary shield on DUR

| Aux Shield type | Material | Dimension | Min/Max 0 to 80 | Min/Max 0 to 40 |
|---|---|---|---|---|
| Control | — | — | 1.61 | 1.43 |
| A-1 | Al | 2.5 cm dia | 1.63 | 1.4 |
| A-2 | Al | 4 cm dia | 1.63 | 1.36 |
| B-1 | Ta | 2.5 × 0.74 cm$^2$ | 1.6 | 1.37 |
| B-2 | Ta | 4 × 1.2 cm$^2$ | 1.58 | 1.31 |
| C-1 | Ta | 2.5 cm hr* + 1 mm full sheet | 1.56 | 1.36 |
| C-2 | Ta | 2.5 cm hr* + 2 mm full sheet | 1.52 | 1.35 |
| C-3 | Ta | 2.5 cm hr* + 3 mm full sheet | 1.51 | 1.36 |
| D | Ta | 3 mm full sheet | 1.53 | 1.51 |

*hr - half-rod

As can be seen from Table 5, the use of Ta as an auxiliary shield reduced the DUR (both Max/Min 0 to 80, and 0 to 40). Furthermore, the shape and size of the shield may be varied to further optimize the DUR within a product.

In the absence of an auxiliary shield, the overall dose received by the product was higher than that observed in the presence of a shield (FIG. 13(*b*)), and characterized as having a higher dose received in the outer regions of the product, and reduce dose in the central region. In the presence of the auxiliary shield, even though the central region received a lower dose, thereby reducing the difference between $D_{max}$ and $D_{min}$ (lower DUR), the outer regions of the product also received a lower dose. The dose distribution profile obtained in the presence of an auxiliary shield was in general characterized as having reduced the overall radiation dose received, and by producing a flatter dose distribution profile throughout the product. The improved results are obtained using an auxiliary shield that spanned the entire collimator aperture, thereby only permitting X-rays of higher energy to enter the product (i.e. hardened the X-ray spectrum).

Example 5

Irradiation of Circular Product: Effect of Beam Offset

The $D_{max}$:$D_{min}$ ratio may also be optimized by offsetting the beam from the axis of product rotation so that the relative fractional exposure time within the different lateral parts of the product are altered.

Figure 14A:
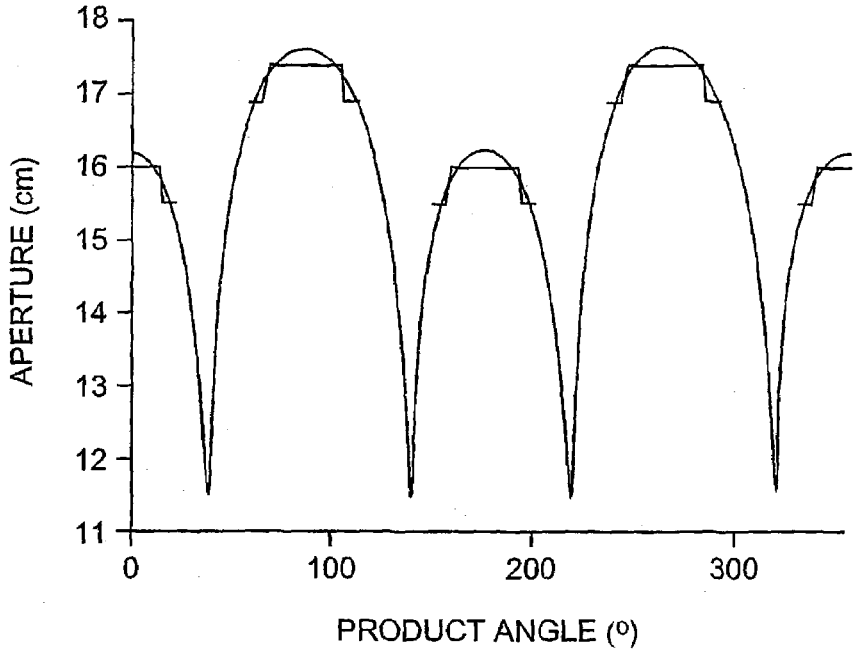
FIG. 14 shows changes in aperture, beam power and beam offset that may be used to optimize DUR within a product.
Figure 14B:
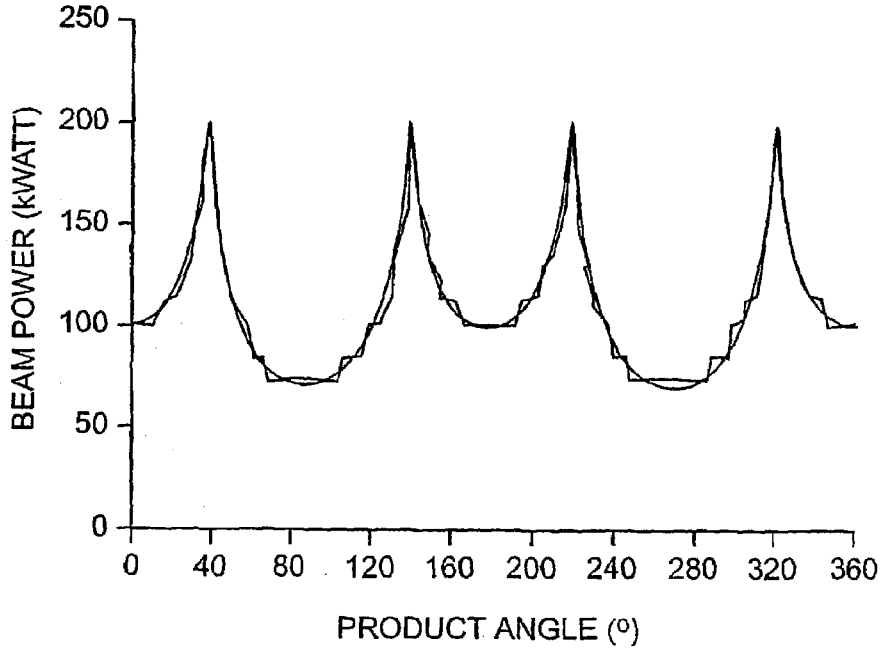
Figure 14C:
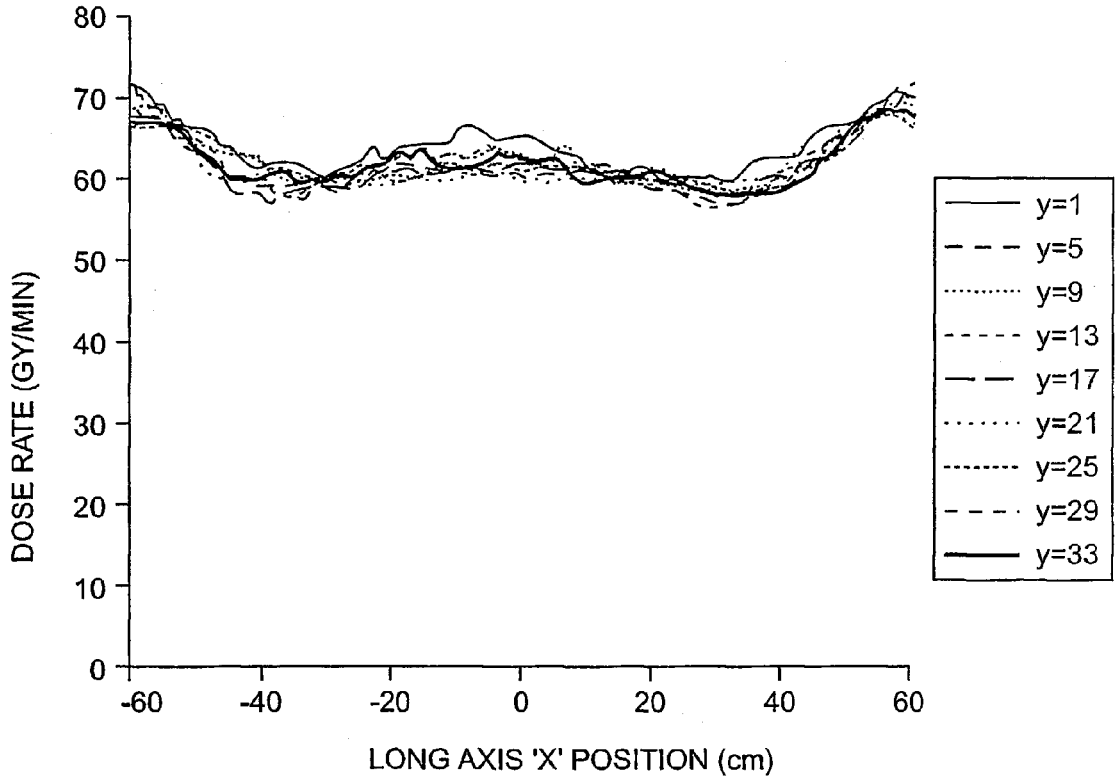

For these analyses, a Ta convertor of 2.35 mm (including a cooling channel; 0.5 cm Al, 1 cm $H_2O$, 0.5 cm Al) is used, with an ebeam energy of 5 Mev (beam current 40 mA; beam power 200 kW max, 78 kW min; 117 kW avg.), an aperture of 9.5 cm., and a distance from the converter to collimator of 32 cm. A rectangular product (100×120 cm), with a density of 0.8 g/cm3 is tested. During radiation, the collimator aperture is modified (as described in Example 2) during rotation of the rectangular product from a min value of 11.5 cm to a max value of 17.5 cm (FIG. 14(*a*)). Also, the beam power is modified as shown in FIGS. 14(*b*) respectively (also see Example 3).

In the present example, beam offset of 7 cm, with respect to the product center, is tested. A beam offset of 7 cm is obtained by angling the beam (aperture inclination angle, $\Theta_A$), by 5° from the center line of the beam. Under these conditions, a DUR (Max/Min) value of 1.4 is observed (FIG. 14(*c*)). However, the use of a narrower collimator aperture (less than 11.5 cm) further reduces the higher doses received at the periphery of the product, and produces a DUR of 1.2.

The dose distribution profile produced as a result of the beam offset is characterized as having smaller regions of low dose, with a higher uniformity across the product.

All publications are herein incorporated by reference.

The present invention has been described with regard to preferred embodiments. However, it will be obvious to persons skilled in the art that a number of variations and modifications can be made without departing from the scope of the invention as described herein.

The embodiments of the invention in which an exclusive property of privilege is claimed are defined as follows:

1. A product irradiator comprising:

a radiation source for producing a radiation beam directed towards a product requiring irradiation, an adjustable collimator positioned between said radiation source and said product, said adjustable collimator having an aperture for shaping said beam, a rotatable turntable for receiving said product, and a control system in operative communication with said adjustable collimator and said turntable configured to adjust the size of said aperture to modulate a width of the beam as a function of an angular orientation of said turntable to produce a substantially uniform dose of radiation throughout the product during irradiation.

2. The product irradiator of claim 1, wherein said radiation source is selected from a group consisting of gamma, X-ray, and electron beam.

3. The product irradiator of claim 2, wherein said radiation source is an X-ray radiation source comprising an electron accelerator for producing high energy electrons, a scanning horn for directing the high energy electrons, and a converter for converting the high energy electrons into X-rays.

4. The product irradiator of claim 3, wherein the converter further comprises a cooling system for dissipating heat produced from conversion of high energy electrons into X-rays in said converter.

5. The product irradiator of claim 1, further comprising a detection system.

6. The product irradiator of claim 5, further comprising an auxiliary shield.

7. The product irradiator of claim 5, wherein said detection system measures at least one of the following parameters: transmitted radiation, instantaneous angular velocity of said turntable, angular orientation of said turntable, power of a radiation beam produced by said radiation source, energy of said radiation beam, width of said radiation beam, vertical scan speed, collimator aperture, position of an auxiliary shield, offset of a radiation beam axis from an axis of rotation of said turntable, distance of said turntable from said collimator, and distance of said collimator from said radiation source.

8. The product irradiator of claim 7, wherein said detection system is operatively linked with said control system.

9. A method using radiation processing comprising:

i) placing a product onto a turntable, rotating said turntable, and establishing at least one of the following properties: length, width, height, density, and density distribution of said product;

ii) modulating a width of a beam as a function of an angular orientation of said turntable by adjusting the size of a collimator aperture;

iii) producing a collimated radiation beam; and iv) rotating said product within said collimated radiation beam for a period of time sufficient to produce a substantially uniform dose of radiation throughout the product.

10. The method of claim 9, wherein, in said step of adjusting, an angular velocity of said turntable is a parameter that is adjusted.

11. The method of claim 10, wherein, in said step of adjusting, said collimated radiation beam is a collimated X-ray beam produced from high energy electrons generated by an electron accelerator, and power of said high energy electrons is adjusted.

12. The method of claim 11, wherein during or following said step of rotating, is:

detecting X-rays transmitted through said product.

13. The method of claim 12, wherein, during or following said step of detecting, is:

processing information obtained in said detecting step by a control system and altering of any of the following parameters: collimator aperture, distance between said turntable and collimator, turntable offset, position of an auxiliary shield, angular velocity of said turntable, and power of said high energy electrons.

14. The method of claim 9, wherein the step of adjusting further comprises adjusting at least one of the following parameters: collimator aperture, distance between said turntable and collimator, turntable offset, and position of an auxiliary shield.

15. A product irradiator comprising:

i) an X-ray radiation source essentially consisting of an electron accelerator for producing high energy electrons, a scanning horn for directing said high energy electrons towards a convertor, said converter for converting said high energy electrons into X-rays to produce an X-ray beam, said X-ray beam directed towards a product requiring irradiation;

ii) an adjustable collimator having an aperture for shaping said X-ray beam;

iii) a rotatable turntable upon which said product is placed, and iv) a control system in operative communication with said electron accelerator, said adjustable collimator, and said turntable, configured to adjust the size of said aperture of said collimator to modulate a width of the beam as a function of an angular orientation of said turntable, to produce a substantially uniform dose of radiation throughout the product.

16. The product irradiator of claim 15, farther comprising a detection system in operative association with said control system.

17. The product irradiator of claim 16, wherein said turntable is movable towards or away from said adjustable collimator, or said turntable is movable laterally, so that an axis of rotation of said product on said turntable is offset from an axis of said X-ray beam.

18. The product irradiator of claim 17, further comprising an auxiliary shield.

19. The product irradiator of claim 18, wherein said detection system measures at least one of the following parameters: transmitted X-ray irradiation, instantaneous angular velocity of said turntable, angular orientation of said turntable, power of said high energy electrons, width of a high energy electron beam, energy of said X-ray beam, aperture of said adjustable collimator, position of said auxiliary shield, offset of said radiation beam from an axis of rotation of said turntable, distance of said turntable from said collimator, and distance of said collimator from said radiation source.

20. A method for irradiating a product on a turntable, comprising:

i) rotating the product on the turntable, said product selected from the group consisting of foodstuffs, powdered goods, medical articles, laboratory supplies, medical waste, and waste;

ii) irradiating the product with a radiation beam during rotation; and iii) modulating a width of the radiation beam as a function of an angular orientation of said turntable by adjusting the size of a collimator aperture to produce a substantially uniform dose of radiation throughout the product.

21. The method of claim 20, further including modulating a rate of rotation of the turntable during irradiation.

22. The method of claim 20, further including modulating an intensity of the radiation beam during rotation.

23. The method of claim 20, further including modulating a rate of rotation of the turntable and the intensity of the radiation beam during rotation.

24. The method of claim 20, further including receiving a signal from a radiation detection system and modulating at least one of: the width of the radiation beam, a rate of rotation of the turntable, and an intensity of the radiation beam, based upon the received signal.

25. The method of claim 20, wherein the radiation beam is an X-ray beam.

26. The method of claim 20, wherein the radiation beam is an X-ray beam produced using bremsstrahlung.

27. The method of claim 20, wherein vertical scan speed of said radiation beam is modulated during product irradiation.

28. A method of radiating a product on a turntable including:

i) rotating the product on the turntable, said product selected from the group consisting of foodstuffs, powdered goods, medical articles, laboratory supplies, medical waste, and waste;

ii) irradiating the product with a radiation beam during rotation;

iii) modulating a rate of rotation of the turntable during rotation; and iv) modulating a width of the radiation beam as a function of an angular orientation of said turntable by adjusting the size of a collimator aperture to produce a substantially unicorn dose of radiation throughout the product.

29. The method of claim 28, further including modulating an intensity of the radiation beam during rotation.

30. The method of claim 28, further including receiving a signal from a radiation detection system and modulating the rate of rotation of the turntable during rotation based upon the signal received from the detection system.

31. The method of claim 28, further including receiving a signal from a radiation detection system and modulating at least one of: the width of the radiation beam, the rate of rotation of the turntable, and an intensity of the radiation beam, based upon the signal received from the detection system.

32. The method of claim 28, wherein the radiation beam is an X-ray beam.

33. The method of claim 28, wherein the radiation beam is an X-ray beam produced using bremsstrahlung.

34. The method of claim 28, wherein the irradiation produces a Dose Uniformity Ratio of between about 1 to about less than 2 in the product.

35. The method of claim 28, wherein vertical scan speed of said radiation beam is modulated during product irradiation.

36. A method for irradiating a product on a turntable comprising:

i) rotating the product on the turntable, said product selected from the group consisting of foodstuffs, powdered goods, medical articles, laboratory supplies, medical waste, and waste;

ii) irradiating the product with a radiation beam during rotation;

iii) modulating an intensity of the radiation beam during rotation; and iv) modulating a width of the radiation beam as a function of an angular orientation of said turntable by adjusting the size of a collimator aperture, to produce a substantially uniform dose of radiation throughout the product.

37. The method of claim 36, further including modulating a rate of rotation of the turntable during rotation.

38. The method of claim 36, further including receiving a signal from a radiation detection system and modulating the intensity of the radiation beam during rotation based upon the signal received from the detection system.

39. The method of claim 36, further including receiving a signal from a radiation detection system and modulating at least one of: the width of the radiation beam, a rate of rotation of the turntable, and the intensity of the radiation beam, based upon the signal received from the detection system.

40. The method of claim 36, wherein the radiation beam is an X-ray beam.

41. The method of claim 36, wherein the radiation beam is an X-ray beam produced using bremsstrahlung.

42. A method for irradiating a product on a turntable comprising:

i) performing a diagnostic scan of the product, said product selected from the group consisting of foodstuffs, powdered goods, medical articles, laboratory supplies, medical waste, and waste;

ii) rotating the product on the turntable;

iii) irradiating the product with a radiation beam during rotation; and iv) modulating a width of the radiation beam as a function of an angular orientation of said turntable by adjusting the size of a collimator aperture, based upon the diagnostic scan, to produce a substantially uniform dose of radiation throughout the product.

43. The method of claim 42, further including modulating a rate of rotation of the product based upon the diagnostic scan.

44. The method of claim 42, further including modulating an intensity of the radiation beam during rotation of the product based upon the diagnostic scan.

45. The method of claim 42, further including modulating a rate of rotation of the product and an intensity of the radiation beam during rotation based upon the diagnostic scan.

46. The method of claim 42, further including generating a signal from a radiation detection system and modulating at least one of: the width of the radiation beam, a rate of rotation of the product, and an intensity of the radiation beam, based upon the signal.

47. The method of claim 42, wherein vertical scan speed of said radiation beam is modulated during product irradiation.

48. A method for irradiating a product on a turntable comprising:

i) performing a diagnostic scan of the product, said product selected from the group consisting of foodstuffs, powdered goods, medical articles, laboratory supplies, medical waste, and waste;

ii) rotating the product on the turntable;

iii) irradiating the product with a radiation beam during rotation;

iv) modulating a rate of rotation of the turntable during rotation, based upon the diagnostic scan; and v) modulating a width of the radiation beam as a function of an angular orientation of said turntable by adjusting the size of a collimator aperture, based upon the diagnostic scan, to produce a substantially uniform dose of radiation throughout the product.

49. The method of claim 48, further including modulating an intensity of the radiation beam during rotation of the product based upon the diagnostic scan.

50. The method of claim 48, further including generating a signal from a radiation detection system and modulating at least one of: the width of the radiation beam, the rate of rotation of the turntable, and an intensity of the radiation beam, based upon the signal.

51. The method of claim 48, wherein vertical scan speed of said radiation beam is modulated during product irradiation.

52. A method for irradiating a product on a turntable to produce a low Dose Uniformity Ratio within the product comprising:

i) performing a diagnostic scan of the product, said product selected from the group consisting of foodstuffs, powdered goods, medical articles, laboratory supplies, medical waste, and waste;

ii) rotating the product on the turntable;

iii) irradiating the product with a radiation beam during rotation;

iv) modulating an intensity of the radiation beam during rotation based upon the diagnostic scan; and v) modulating a width of the radiation beam as a function of an angular orientation of said turntable by adjusting the size of a collimator aperture, based upon the diagnostic scan, to produce a substantially uniform dose of radiation throughout the product.

53. The method of claim 52, further including modulating a rate of rotation of the product based upon the diagnostic scan.

54. The method of claim 52, further including generating a signal from a radiation detection system and modulating at least one of: the width of the radiation beam, a rate of rotation of the turntable, and the intensity of the radiation beam, based upon the received signal.

55. An apparatus for irradiating a product, comprising, a radiation detection system that measures an amount of radiation absorbed by at least part of the product, a radiation source for producing a beam, said beam directed towards said product, an adjustable collimator having an aperture for shaping said beam, said adjustable collimator positioned between said radiation source and said product, a rotatable turntable for receiving said product, and a control system in operative communication with said adjustable collimator, and said turntable, wherein each of said radiation source, adjustable collimator and turntable have at least one parameter that is capable of being adjusted automatically based upon a measurement made by the detection system to achieve a low Dose Uniformity Ratio in a product during irradiation, and wherein the control system comprises instructions for adjusting the size of said aperture of said collimator to modulate a width of the beam as a function of an angular orientation of said turntable to produce a substantially uniform dose of radiation throughout the product.

56. The apparatus of claim 55, wherein the at least one adjustable parameter for the source is beam power.

57. The apparatus of claim 55, wherein the at least one adjustable parameter for the turntable is instantaneous turntable rotation rate.

58. The apparatus of claim 55, wherein the radiation source is an X-ray beam.

59. The apparatus of claim 55, wherein the radiation source is an X-ray beam produced using bremsstrahlung.

60. The apparatus of claim 55, wherein the radiation source comprises an electron accelerator that produces an electron beam, a scanning horn, and a converter to convert the electron beam into X-rays.

61. The apparatus of claim 60, wherein the converter is a Ta converter.

62. The apparatus of claim 55, wherein the radiation source is offset from an axis of rotation of the turntable.

63. The apparatus of claim 55, further comprising an auxiliary shield.

64. The apparatus of claim 63, wherein the auxiliary shield extends across the entire aperture of the collimator.

65. The apparatus of claim 63, wherein the auxiliary shield is of a width that is less than that of an aperture of the collimator.

66. The apparatus of claim 63, wherein the auxiliary shield is a Ta auxiliary shield.

67. The apparatus of claim 55, wherein the radiation detection system is adapted for operation during a diagnostic scan before the irradiation.

68. The apparatus of claim 55, wherein the radiation detection system is adapted for operation during a diagnostic scan during the irradiation.

69. A medium storing instructions adapted to be executed by a processor to modulate a the size of a collimator aperture to adjust a width of a radiation beam as a function of an angular orientation of a turntable, while a product is being rotated by said turntable, to produce a substantially uniform dose of radiation throughout the product, and irradiated by said radiation beam, and to modulate vertical scan speed, wherein the radiation beam is collimated by the collimator.

70. The medium of claim 69, wherein the instructions are further adapted to be executed by a processor to modulate a rate at which the product is rotated during irradiation.

71. The medium of claim 69, wherein the instructions are further adapted to be executed by a processor to modulate an intensity of the radiation beam during irradiation.

72. The medium of claim 69, wherein the instructions are further adapted to be executed by a processor to modulate a rate at which the product is rotated and an intensity of the radiation beam during irradiation.

73. The medium of claim 69, wherein the instructions are further adapted to be executed by a processor to produce a low Dose Uniformity Ratio in the product.

74. A medium storing instructions adapted to be executed by a processor to modulate a rate of rotation of a turntable and to modulate the size of a collimator aperture, to produce a substantially uniform dose of radiation throughout a product with a Dose Uniformity Ratio (DUR) of between about 1 to less than about 2, while the product is being irradiated by a radiation beam, wherein the size of said collimator aperture is adjusted to modulate a width of the radiation beam as a function of an angular orientation of said turntable.

75. The medium of claim 74, wherein the instructions are further adapted to be executed by a processor to modulate an intensity of the radiation beam during irradiation.

76. A medium storing instructions adapted to be executed by a processor to modulate an intensity of a radiation beam and the size of a collimator aperture, while a product is being rotated by a turntable, said turntable rotatable through 360°, and irradiated by the radiation beam, and to modulate vertical scan speed of the radiation beam, wherein the size of said collimator aperture is adjusted to modulate a width of the radiation beam as a function of an angular orientation of said turntable, to produce a substantially uniform dose of radiation throughout the product.

77. The medium of claim 76, wherein the instructions are further adapted to be executed by a processor to produce a low Dose Uniformity Ratio in the product.

78. A medium storing instructions adapted to be executed by a processor to receive data from a detection system and to modulate the size of a collimator aperture to adjust a width of a radiation beam as a function of an angular orientation of a turntable, based upon the received data, and to modulate a vertical scan speed, wherein the collimator collimates a radiation beam that irradiates a product, to produce a substantially uniform dose of radiation throughout the product.

79. The medium of claim 78, wherein the instructions are further adapted to be executed by the processor to modulate a rate at which the product is rotated, based upon data received from the detection system.

80. The medium of claim 78, wherein the instructions are further adapted to be executed by the processor to modulate an intensity of the radiation beam, based upon data received from the detection system.

81. The medium of claim 78, wherein the instructions are further adapted to be executed by the processor to modulate a rate of rotation of the product and an intensity of the radiation beam, based upon data received from the detection system.

82. The medium of claim 78, wherein data received from the detection system is generated during a diagnostic scan before the product is irradiated.

83. The medium of claim 78, wherein data received from the detection system is generated during a diagnostic scan while the product is irradiated.

84. A medium storing instructions adapted to be executed by a processor to receive data from a detection system that characterizes a product, to modulate a rate of rotation of a turntable, and to modulate the size of a collimator aperture to adjust a width of a radiation beam as a function of an angular orientation of said turntable, based upon the received data, to produce a substantially uniform dose of radiation throughout the product.

85. The medium of claim 84, wherein the instructions are further adapted to be executed by the processor to modulate vertical scan speed, based upon data received from the detection system.

86. The medium of claim 84, wherein the instructions are further adapted to be executed by the processor to modulate an intensity of a radiation beam, based upon data received from the detection system.

87. The medium of claim 84, wherein data received from the detection system is generated during a diagnostic scan before the product is irradiated.

88. The medium of claim 84, wherein data received from the detection system is generated during a diagnostic scan while the product is irradiated.

89. A medium storing instructions adapted to be executed by a processor to receive data from a detection system characterizing a product, to modulate an intensity of a radiation beam, to modulate the size of a collimator aperture to adjust a width of the radiation beam as a function of an angular orientation of a turntable, and to modulate vertical scan speed of the radiation beam, based upon the received data, to produce a substantially uniform dose of radiation throughout the product.

90. A system for irradiating a product comprising;

i) means for producing a radiation beam;

ii) means for measuring an amount of radiation absorbed by at least part of the product;

iii) means for adjustably setting a width of the radiation beam that irradiates the product;

iv) means for rotating the product; and v) control means in operative communication with said means for adjustably setting a width of the radiation beam and said means for rotating the product, said control means comprising instructions for modulating a rate of rotation of the product and modulating the width of the radiation beam as a function of an angular orientation of said means for rotating the product by adjusting a size of a collimator aperture during irradiation, based upon a measured amount of radiation absorbed by at least a part of the product, to produce a substantially uniform dose of radiation throughout the product during irradiation.

91. The system of claim 90, further comprising means for modulating an intensity of the radiation beam based upon the measured amount of radiation absorbed by at least part of the product.

* * * * *